United States Patent [19]

Virta et al.

[11] Patent Number: 4,608,038

[45] Date of Patent: Aug. 26, 1986

[54] APPARATUS AND METHOD FOR LINING, FOLDING AND GLUING CONTAINER BLANKS

[75] Inventors: Arthur W. Virta, Mt. Prospect; Fred E. Ullman, Glencoe, both of Ill.

[73] Assignee: A. W. Virta & Associates, Inc., Wheeling, Ill.

[21] Appl. No.: 666,500

[22] Filed: Oct. 30, 1984

[51] Int. Cl.[4] ..... B31B 7/02; B31B 7/26; B31B 1/62

[52] U.S. Cl. ..... 493/29; 493/14; 493/96; 493/110; 493/141

[58] Field of Search ..... 493/93, 96, 110, 10, 493/29, 123, 124, 125, 126, 141, 142, 147, 151, 179, 14

[56] References Cited

U.S. PATENT DOCUMENTS

| | | | |
|---|---|---|---|
| 2,015,202 | 9/1935 | Stokes | 493/110 |
| 2,057,264 | 11/1935 | Pierce | 118/40 |
| 2,432,053 | 12/1941 | Waters | 493/276 |
| 2,502,117 | 3/1948 | Anderson | 493/18 |
| 3,003,760 | 10/1961 | Scheu et al. | 493/27 |
| 3,072,095 | 4/1962 | Keessen et al. | 118/685 |
| 3,353,459 | 10/1964 | Owsley | 493/96 |
| 3,388,640 | 6/1966 | Giannella | 493/96 |
| 3,392,637 | 7/1966 | Back | 493/96 |
| 3,459,105 | 6/1967 | Waldbauer | 493/124 |
| 3,580,141 | 5/1971 | Richter | 493/27 |
| 3,611,884 | 1/1971 | Hottendorf | 493/60 |
| 3,772,121 | 6/1971 | Peltier et al. | 156/293 |
| 3,964,953 | 6/1976 | Mitchard | 156/300 |
| 3,986,441 | 10/1976 | Jaton | 493/96 |
| 4,197,789 | 4/1980 | Moen | 493/96 |
| 4,287,704 | 9/1981 | Meyers et al. | 53/564 |
| 4,368,052 | 1/1983 | Bitsky et al. | 493/96 |

FOREIGN PATENT DOCUMENTS

| | | | |
|---|---|---|---|
| 2085791 | 5/1982 | United Kingdom | 493/340 |

*Primary Examiner*—Francis S. Husar
*Assistant Examiner*—William E. Terrell
*Attorney, Agent, or Firm*—Dressler, Goldsmith, Shore, Sutker & Milnamow, Ltd.

[57] ABSTRACT

An apparatus and method are disclosed for serially and automatically folding and gluing container body blanks, with optional lamination of a liner to the body blank prior to folding and gluing thereof. The apparatus includes a blank conveyor arrangement which intermittently advances a body blank along a horizontal straight-line work path through the apparatus. Arrangements are provided for applying adhesive to a flap portion of the body blank, folding the body blank about spaced parallel score lines thereof, and applying pressure to the blank to form a so-called manufacturer's joint at the flap portion. The present apparatus further includes an arrangement for advancing an inner liner into the apparatus in a direction transverse of the body blank work path, with an arrangement provided for maintaining the liner in a horizontally fixed stopped position above the blank work path, and for subsequently lowering the liner into superposition on a container body blank prior to folding and gluing of the blank.

21 Claims, 35 Drawing Figures

13
182
184
186
180
188
190
80
170
172
174
176
168
166
178
12
98'
90
L
B 190
183
192
186
188
176
180
14
14
186
188
190
176
178
178
80
90
98'
98
84
86
88
168
168
166
166
98'
90
118
118
120
120
L
L
B

FIG. 26
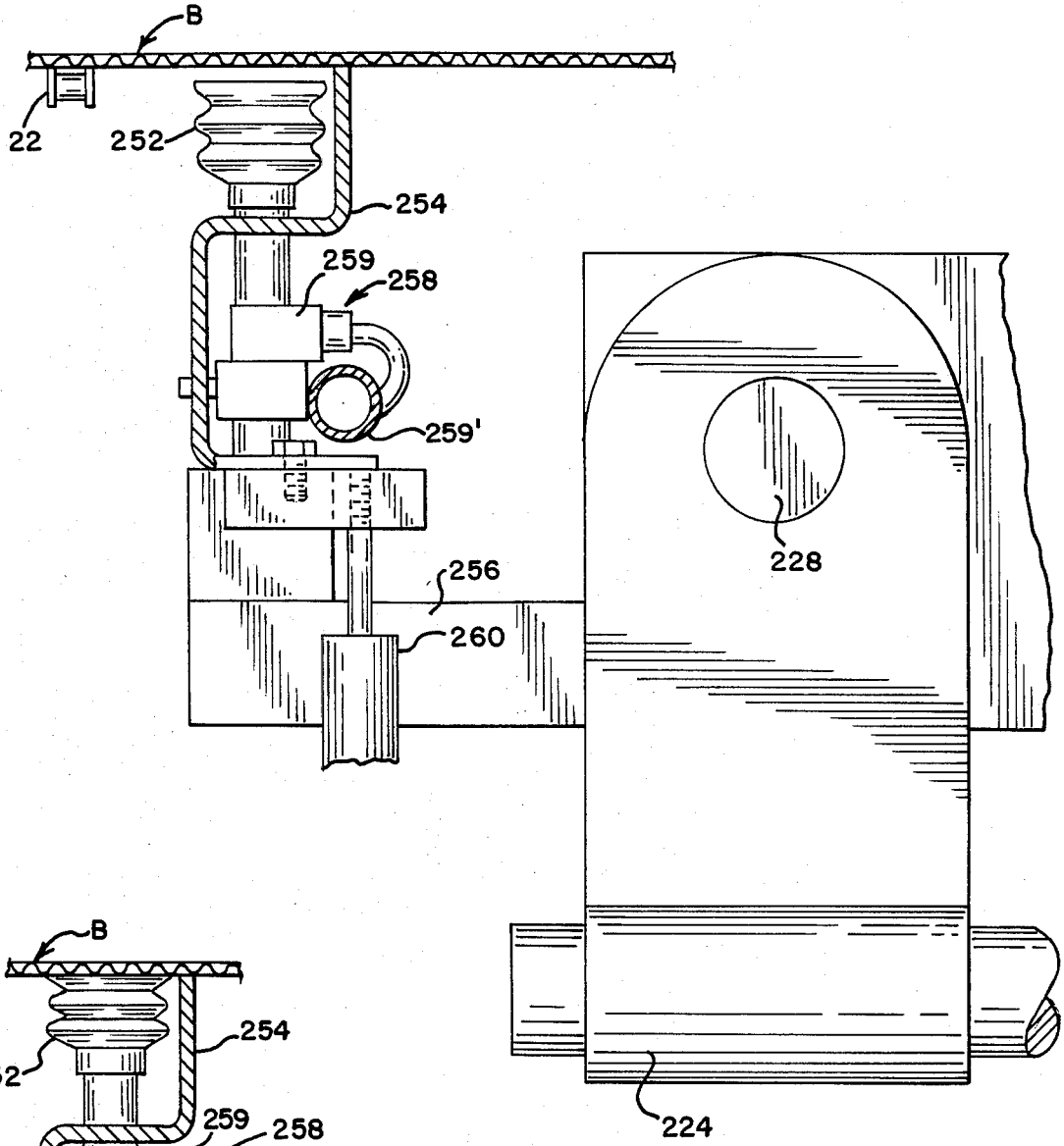
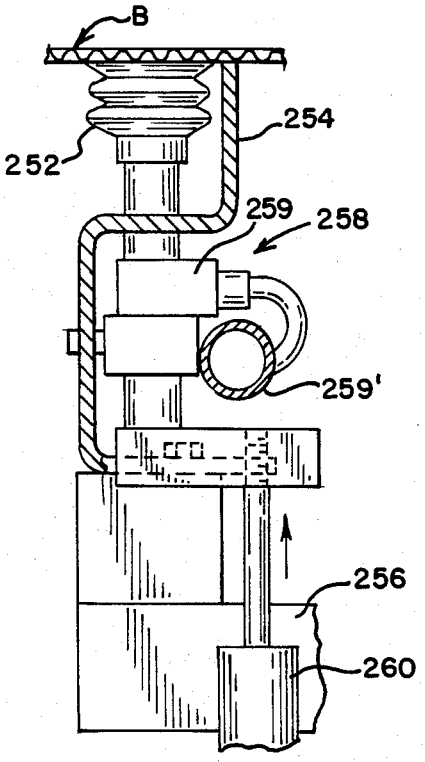
FIG. 27

APPARATUS AND METHOD FOR LINING, FOLDING AND GLUING CONTAINER BLANKS

TECHNICAL FIELD

The present invention relates generally to a method and apparatus for folding and gluing container blanks, and more particularly to a highly-automated and relatively compact apparatus which provides advancement of flat container body blanks of scored corrugated material along a work path, with optional lamination of a liner to portions of each body blank, and subsequent folding and gluing of each body blank along scored portions thereof to provide folded body blanks of a flattened, tubular configuration.

BACKGROUND OF THE INVENTION

Large corrugated containers are widely used for shipment of large manufactured items, as well as for storage and shipment of particulate material such as plastic resin pellets. Containers of this nature are typically formed from a pre-scored corrugated blank by folding the blank about score lines thereof to bring portions of the blank into juxtaposition to form an adhesive joint. Such a joint is referred to in the art as a "manufacturer's joint", with the resultant folded blank having a flattened, tubular configuration. The flattened, folded container body blanks are subsequently "opened" for use to form shipping containers.

In order to enhance the strength of such containers, it is frequently desirable to laminate a prescored liner in registry with the so-called panel portions of the container blank. Lamination of the liner to selected portions of each body blank provides the desired strength for the resultant container, and permits efficient formation of the final container by folding of unlaminated, so-called end flap portions of the body blank.

U.S. patent application Ser. No. 383,581, filed June 1, 1982, now U.S. Pat. No. 4,563,169, Jan. 7, 1986, discloses an apparatus and method for very efficiently folding and gluing prescored container body blanks such as described above. One of the coinventors of the present invention is a named coinventor of the above application, with ownership of the present application being common with said coinventor's undivided interest in the above application. The aforesaid application additionally illustrates lamination of a liner to selected portions of the container body blank prior to folding and gluing of the body blank. The present invention concerns a number of significant improvements to the method and apparatus of the aforesaid patent application, including a highly automated and accurate arrangement for cyclically laminating prescored corrugated liners to prescored corrugated container body blanks.

SUMMARY OF THE INVENTION

The apparatus of the present invention has been particularly configured for highly efficient and substantially fully-automated folding and gluing of prescored corrugated container body blanks, with the apparatus optionally being configured to effect very accurate lamination of a prescored corrugated liner to each body blank prior to folding and gluing thereof. Generally, lamination, folding, and gluing of each body blank is effected as the body blank is intermittently advanced along a straight-line horizontal work path by a body blank conveyor. Intermittent advancement of the body blank avoids the problems associated with prior art arrangements which effect folding or the like during constant advancement of the body blank, with the highly automated nature of the apparatus permitting efficient operation with minimum operator supervision. Lamination of liners to the body blanks is also highly automated, and is effected with a degree of accuracy and speed which heretofore has been very difficult to achieve. Additionally, the present apparatus has been configured for highly versatile use, and can be readily adjusted for laminating, folding, and gluing body blanks within a wide dimensional range and of a wide variety of differing configurations.

The present apparatus includes a generally elongated frame having a blank loading end at which prescored body blanks are serially loaded (manually or automatically), and a blank discharge end at which the folded and glued (and laminated if a liner is applied) body blanks are discharged. The apparatus further includes a body blank conveyor mounted on the frame for intermittently advancing a body blank along a straight-line horizontal work path relative to the frame from the blank loading end to the blank discharge end. Notably, the body blank conveyor includes a plurality of laterally spaced pairs of self-locking conveyor grippers each of which includes a spring-loaded jaw mechanism. Each pair of grippers is adapted to receive the leading edge of a body blank when the blank is loaded into the apparatus, with the grippers securely holding the leading edge of the body blank for advancing the blank along the work path.

When the present apparatus is employed for folding and gluing laminated body blanks, the apparatus is provided with a liner conveyor which is mounted on the apparatus frame for advancing a prescored corrugated liner in a direction tranversely of and perpendicular to the body blank conveyor into a position above the work path defined by the body blank conveyor. In the preferred embodiment, the liner conveyor is configured similarly to the body blank conveyor, and accordingly, includes at least two self-locking conveyor grippers adapted to receive and grip the leading edge of the liner as it is manually or automatically loaded into the apparatus.

The liner conveyor advances the liner to be laminated to the body blank to a horizontally fixed stopped position above the work path of the body blank. During advancement of the liner, the liner is received and supported by a pair of parallel support rails positioned on respective opposite sides of the liner conveyor. The support rails are configured to support and confine the opposite edge portions of the liner as it is advanced, and to releasably support the liner in spaced relation above the body blank work path for subsequent superposition of the liner onto a body blank such that prescored lines of the liner are in registry with corresponding prescored lines of the body blank.

In order to laminate the liner to the body blank, means are provided for applying adhesive to one of the body blank and the liner. In the preferred embodiment, such adhesive applying means is provided on the apparatus frame above the work path of the body blank generally at the blank loading end. The apparatus operates such that adhesive is applied to the body blank as the body blank is advanced from the blank loading end of the frame into a position below the liner conveyor, with a liner being supported above the work path by the spaced-apart liner support rails. Sensing means is preferably provided for sensing disposition of the liner in its ready-to-advance position in the liner conveyor in order to prevent advancement of a body blank from the blank loading end, and thus application of adhesive thereto, unless the liner is ready to be advanced by the liner conveyor. If a previously-fed liner is already in position for lowering onto a body blank, advancement of the body blank for application of adhesive thereto can be effected.

Notably, the present apparatus includes an arrangement for "squaring up" the body blank with respect to the liner prior to superpositioning of the liner on the body blank. This arrangement includes a pair of vertically movable, laterally spaced stops which are positioned in operative association with the body blank conveyor. Sensing means is provided in association with each of the stops for sensing simultaneous engagement of the leading edge of the body blank with each of the stops when the body blank is advanced by the blank conveyor from the blank loading end to a position beneath the liner supported by the liner support rails. The sensing means controls advancement or indexing of the body blank conveyor so that the blank conveyor continues to transport the blank until simultaneous engagement of the leading edge of the blank with both of the stops is effected. As will be appreciated, this acts to position the body blank with the parallel score lines thereof in parallel relation to the work path along which the blank is advanced.

In order for the desired "squaring up" to be effected, each of the pairs of grippers holding the leading edge of the body blank are configured to permit limited withdrawal of the leading edge from the gripper jaw mechansim. Since the force required for effecting this partial withdrawal of the leading edge from the grippers is greater than the force generated by the grippers on the blank during acceleration of the blank during the conveyor indexing, the grippers otherwise function to index and advance the blank in the intended manner.

Once the body blank has been positioned beneath the liner at the lamination station, the body blank conveyor is stopped, and the liner is lowered into precise superposition on the body blank, with corresponding scored lines of the blank and the liner in registry. To effect this lowering of the liner, the apparatus includes a plurality of selectively adjustably positionable, vertically movable vacuum cups for applying vacuum to the upper surface of the liner. These vacuum cups, which are maintained in an upper, out-of-the-way disposition as the liner is advanced on the support rails by its conveyor, are moved downwardly to grip the liner by vacuum, and subsequently lower the liner onto the body blank therebelow and apply pressure thereto for initially adhering the liner to the blanks. During this action, the opposite edge portions of the liner being held by the liner support rails are released from the support rails. Additionally, a bar cam is operated to open the liner conveyor grippers to release the leading edge of the liner from the pair of grippers, with the liner conveyor then indexed, thus avoiding interference with the grippers as the liner is lowered into superposition on the body blank.

Since folding of the laminated body blank is to be effected downstream of the lamination station, lamination of the liner to the body blank is preferably effected with a combination of "hot melt" and "cold set" adhesives. In this manner, the hot melt adhesive acts to quickly adhere central portions of the liner and body blank together for subsequent folding of the laminated body blank thus formed.

As the laminated body blank is advanced by the blank conveyor downstream to the folding station, adhesive is applied to a flap portion of the laminated body blank and/or mating portion of the liner or body blank for formation of a "manufacturer's" adhesive joint attendant to folding of the laminated blank. Adhesive-applying means is preferably provided on the apparatus frame so that the adhesive for forming this joint is applied to the flap portion of the body blank during advancement or indexing to the folding station.

At the folding station, the body blank conveyor is stopped, and a pair of folding arm mechanisms arranged generally on respective opposite sides of the body blank conveyor are actuated. The folding arms operate in differentially timed relation to each other so that the laminated body blank is folded onto itself about two of the spaced apart score lines thereof. By this action, the flap portion of the body blank is brought into juxtaposition with a side panel portion of the blank, thus providing the desired adhesive joint for the folded and laminated blank.

In order to retain the central portion of the body blank (i.e., the blank portion between the parallel score lines thereof at which folds are formed) generally in the plane of the conveyor work path during folding, an arrangement of vertically movable vacuum cups is provided for applying vacuum to the lower surface of the central portion of the body blank. Notably, the vacuum cups employed to effect this retention during folding are preferably of a bellows-like configuration such that the cups will shorten or "collapse" as they contact the body blank and vacuum is established, thus firmly retaining the laminated body blank in position, and acting to "flatten" warps or irregularities in the body blank. Retention of the central portion of the blank in this manner, together with retention by the grippers of the body blank conveyor, prevents lifting of the central portion of the body blank for efficient folding.

After folding of the body blank such that the desired manufacturer's adhesive joint is formed, it is desirable to apply pressure to the adhesive joint so that the body blank is maintained in its folded condition. To this end, a vertically movable hold-down roller can be employed for applying pressure to the adhesive joint formed as the folded and laminated body blank is advanced downstream of the folding station by the blank conveyor.

In order to ensure the integrity of the laminated construction, it is desirable to apply pressure to substantially the entire surface of the folded and laminated body blank. To accomplish this, the blank is indexed by the conveyor to a position beneath pressure-applying compression platen means. The blank conveyor is stopped, and pressure applied to the laminated body blank by the compression platen means for a period of time sufficient to permit at least initial setting of the cold set adhesive which laminates the liner to the body blank.

In distinction, folding and gluing of a body blank which does not include a laminated liner does not require the application of pressure to the entire folded blank, but rather, pressure is preferably applied to the adhesive joint formed in the folded body blank. Thus, a modified form of the present apparatus is disclosed which includes a relatively narrow, vertically movable pressure platen for applying pressure to the adhesive joint as the folded body blank is stopped. In this modified embodiment, the pressure platen and aforesaid hold-down roller are mounted on the apparatus frame for movement together transversely of the blank work path, with a power screw arrangement or like drive means provided for selectively moving the hold-down roller and the pressure platen transversely of the work path. This feature of the present invention permits the hold-down roller and the pressure platen to be very easily positioned for the desired application of pressure to the adhesive joint for differently sized and configured body blanks, which may require that the manufacturer's joint is off-center with respect to the centerline of the body blank conveyor.

The above-described pressure-applying arrangements are positioned just upstream of the discharge end of the apparatus. Thus, after pressure has been applied to the folded (and laminated) body blank, the blank is advanced by the blank conveyor to the discharge end of the apparatus. Notably, the present apparatus includes an outfeed control arrangement which receives the folded body blank from the grippers of the body blank conveyor. The outfeed control arrangement includes a plurality of upper and lower rollers positioned to respectively engage the upper and lower surfaces of the folded body blank.

In order to release the leading edge of the body blank from the conveyor grippers, gripper release cam means are provided against which the grippers react for opening their respective jaw mechanisms. During this releasing action, the body blank is in between the upstream ones of the upper and lower rollers of the outfeed control mechanism. Either the upper rollers, or the lower rollers, and preferably both, are driven continuously at an effective rate which is less than the rate of advancement of the body blank by the body conveyor.

Thus, as the body blank is drawn into the outfeed control arrangement and is released from the conveyor grippers, the rollers act to slow the body blank, thus permitting the conveyor grippers to move out of the way and return toward the blank loading end of the apparatus along a lower, return run of the blank conveyor. The outfeed control rollers continue to advance the folded blank until the blank is completely discharged from the apparatus. This outfeed control arrangement is distinct from previous constructions which have employed forward surfaces of the next following pairs of grippers of the blank conveyor for ejection of the folded blank from the apparatus by contact with its trailing edge. Thus, undesired deformation of the trailing edge of the folded blank is avoided.

Numerous other features and advantages of the present invention will become readily apparent from the following detailed description, the accompanying drawings, and the appended claims.

BRIEF DESCRIPTION OF THE DRAWINGS

FIG. 26 is an enlarged view taken along line 26—26 of FIG. 23 illustrating an arrangement for applying vacuum to a lower surface of a body blank during folding thereof;

FIG. 27 is a view illustrating vertical movement of the vacuum applying means shown in FIG. 26;

DETAILED DESCRIPTION

Figure 1:
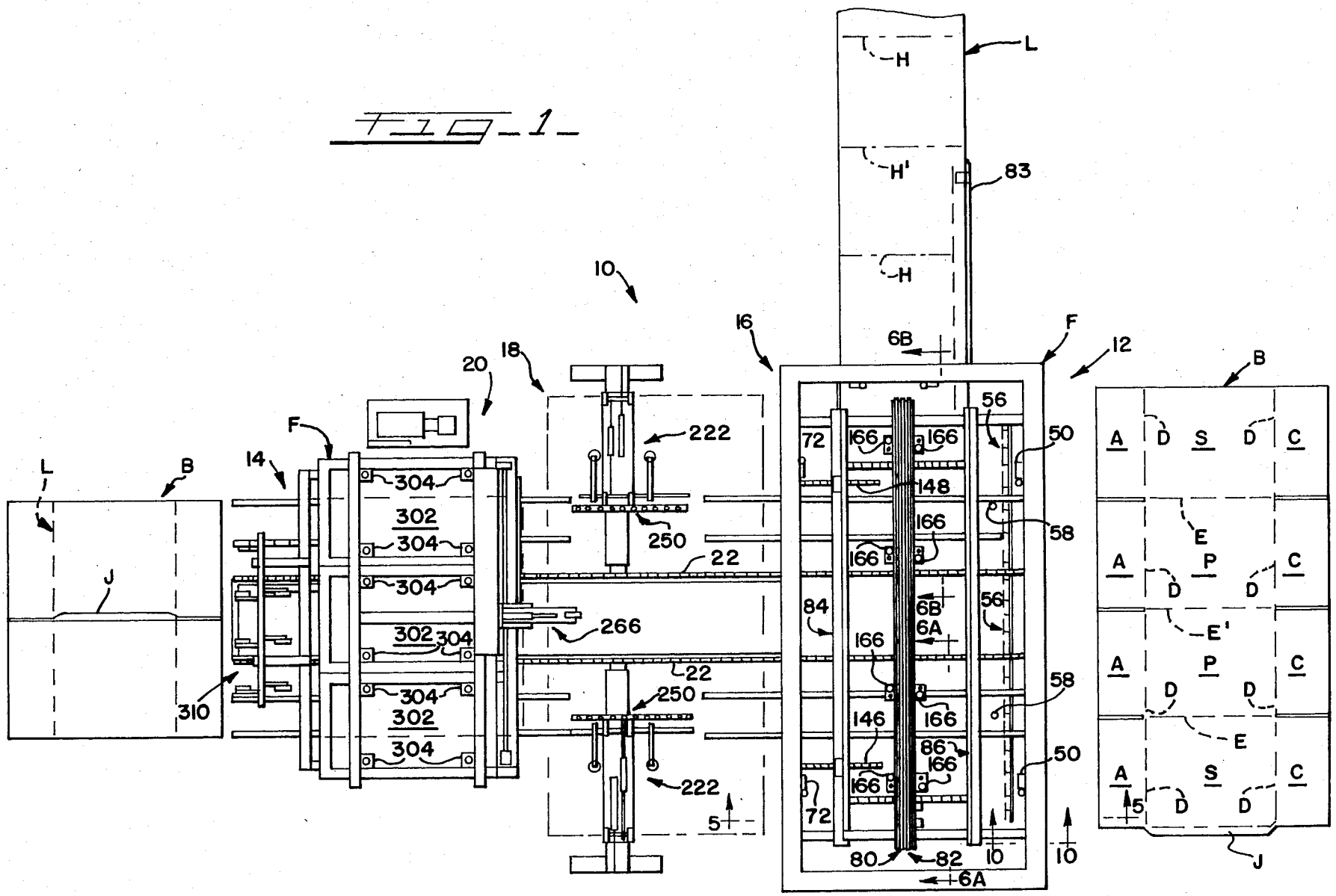
FIG. 1 is a top plan view of the present container folding and gluing apparatus, including means for laminating a liner to a container body blank being folded and glued.

While the present invention is susceptible of embodiment in various forms, there is shown in the drawings and will hereinafter be described a presently preferred embodiment, and modified forms thereof, with the understanding that the present disclosure is to be considered as an exemplification of the invention, and is not intended to limit the invention to the specific embodiments illustrated.

It is to be noted that for purposes of clarity, the various components of the present apparatus have not been illustrated in all of the views in which such components might otherwise appear. From the various drawings, the interrelationship of the components of the apparatus will be clearly understood.

Figure 2:
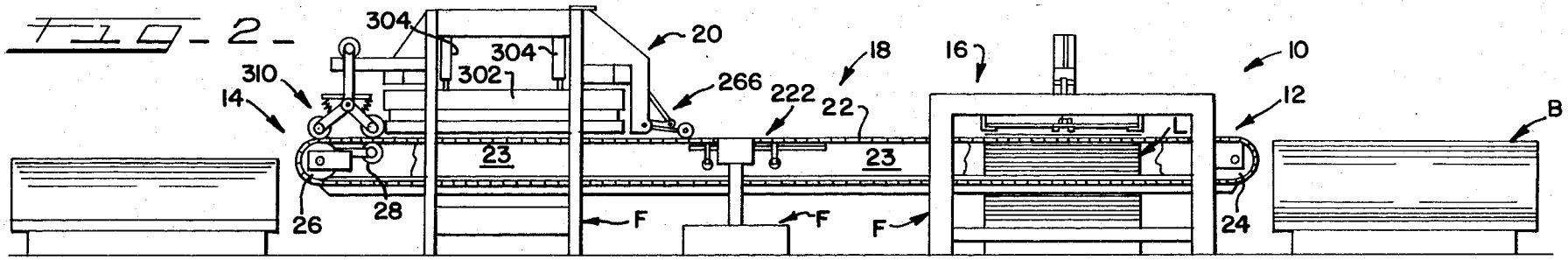
FIG. 2 is a side elevational view of the present folding and gluing apparatus.
Figure 4:
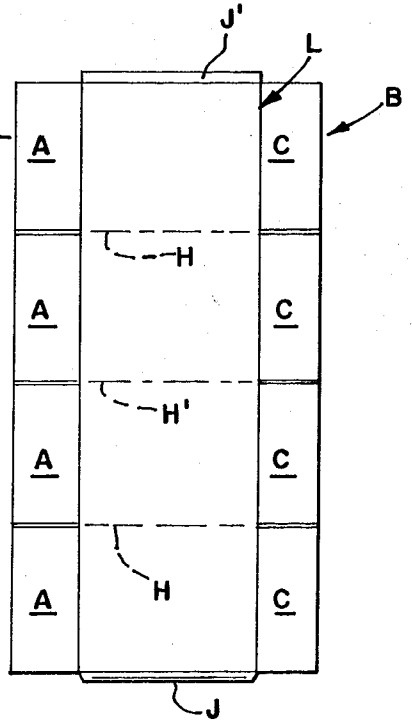
FIG. 4 is a top plan view of the body blank illustrated in FIG. 3, shown with a reinforcing liner superposed thereon.

With reference first to FIGS. 1 and 2, therein is illustrated a container folding and gluing apparatus 10 embodying the principles of the present invention. In the illustrated embodiment, the apparatus is configured to not only effect cyclic folding and gluing of serially loaded container body blanks, designated B in the drawings, but is further configured to laminate liners L to the body blanks B prior to folding and gluing of the body blanks.

As will be described in greater detail, the present apparatus includes a frame F along which body blanks B are serially conveyed from a blank feed end 12 to a blank discharge end 14. The body blanks are intermittently advanced or indexed along a straight-line horizontal work path, from the blank feed end to a lamination station 16 downstream thereof, to a folding station 18, and to a pressure-applying compression station 20 before the blanks are discharged from the apparatus. Each of these stations will be described in greater detail hereinafter.

Figure 3:
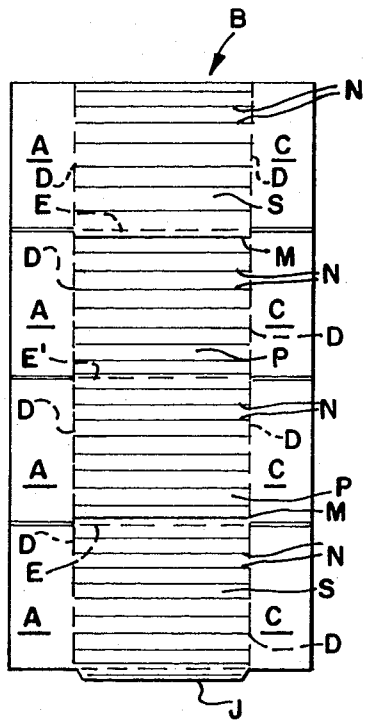
FIG. 3 is a top plan view of a typical container body blank illustrating disposition of adhesive thereon.

Referring particularly to FIG. 3, therein is illustrated a typical prescored corrugated container body blank B. As will be recognized by those familiar with the art, the body blank typically includes two centrally disposed panel portions P distinguished from each other by a score line E', and two side panel portions S each distinguished from the adjacent panel portion P by a score line E. During folding of the body blank by the present apparatus, folding is typically effected about the parallel score lines E so that side panels S are brought into confronting relation with panels P. Attendant to folding, a flap portion J of the blank is moved into juxtaposition with the oppositely disposed side panel S for formation of a so-called "manufacturer's" adhesive joint. The present apparatus is configured to effect folding and gluing in this manner such that the body blank is discharged from the apparatus in a flattened, generally tubular configuration (see FIG. 1, at discharge end 14).

Typically, the body blank B is provided with end flap portions joined to each of the panels S and P. For purposes of the present disclosure, the end flap portions of the body blank which define the leading edge of the blank (referring to its direction of travel through the apparatus) are designated A, while the end flaps which define the trailing edge of the body blank are designated C. The end flaps A are typically distinguished from each other by slits provided therebetween, with each end flap A joined to the adjacent panel of the blank at a score line D. Similarly, the end flaps C are distinguished from each other by slits therebetween, with each end flap joined to the adjacent panel at a score line D.

While the present apparatus can be readily configured for folding and gluing body blanks B without lamination of a liner thereto, the present apparatus is illustrated in the drawings as including lamination station 16 for effecting lamination of a liner L in superposition on the panel portions P and S of body blank B. The liners L typically comprise prescored corrugated material, with score lines H and H'.

For purposes of the present disclosure, lamination of liner L to body blank B will be described such that score lines H of the liner are positioned in registry with score lines E of the body blank, with folding of the laminated body blank being effected about score lines E/H and E/H. Such liner lamination can be effected such that the liner extends to cover the flap portion J of the body blank B, and/or extend beyond the opposite body blank panel to form a flap portion J'.

Attendant to folding, flap portion J of the body blank will be moved into juxtaposition with an opposite end of the blank for formation of the desired adhesive joint. Notably, the present apparatus includes a number of features for adjustably positioning its various components, thus not only permitting the apparatus to handle body blanks and liners within a wide dimensional range, but further permitting formation of the desired adhesive joint in off-center relation with respect to the centerline of the horizontal work path through the apparatus along which the body blank is intermittently advanced.

Indexed advancement of body blank B through the apparatus from blank loading end 12 to discharge end 14 is effected by a body blank conveyor comprising a pair of roller link blank conveyor chains 22 which extend in spaced parallel relation substantially throughout the length of apparatus 10. Each conveyor chain is guided about a respective chain guide 23 having enlarged edge portions 23' (see FIG. 5A). Blank support plates 25 are provided which extend between the upper runs of the chains 22 for supporting central portions of blanks B transported by the conveyor.

Each conveyor chain 22 is entrained about a respective chain sprocket 24 positioned generally at blank loading end 12, and a respective chain sprocket 26 positioned generally at discharge end 14. Drive motor 28 drives sprockets 26 for intermittently advancing the chains, with the upper runs of the chains 22 generally defining a straight-line horizontal work path through the apparatus along which body blanks B are serially conveyed.

Figures 5, 5A:
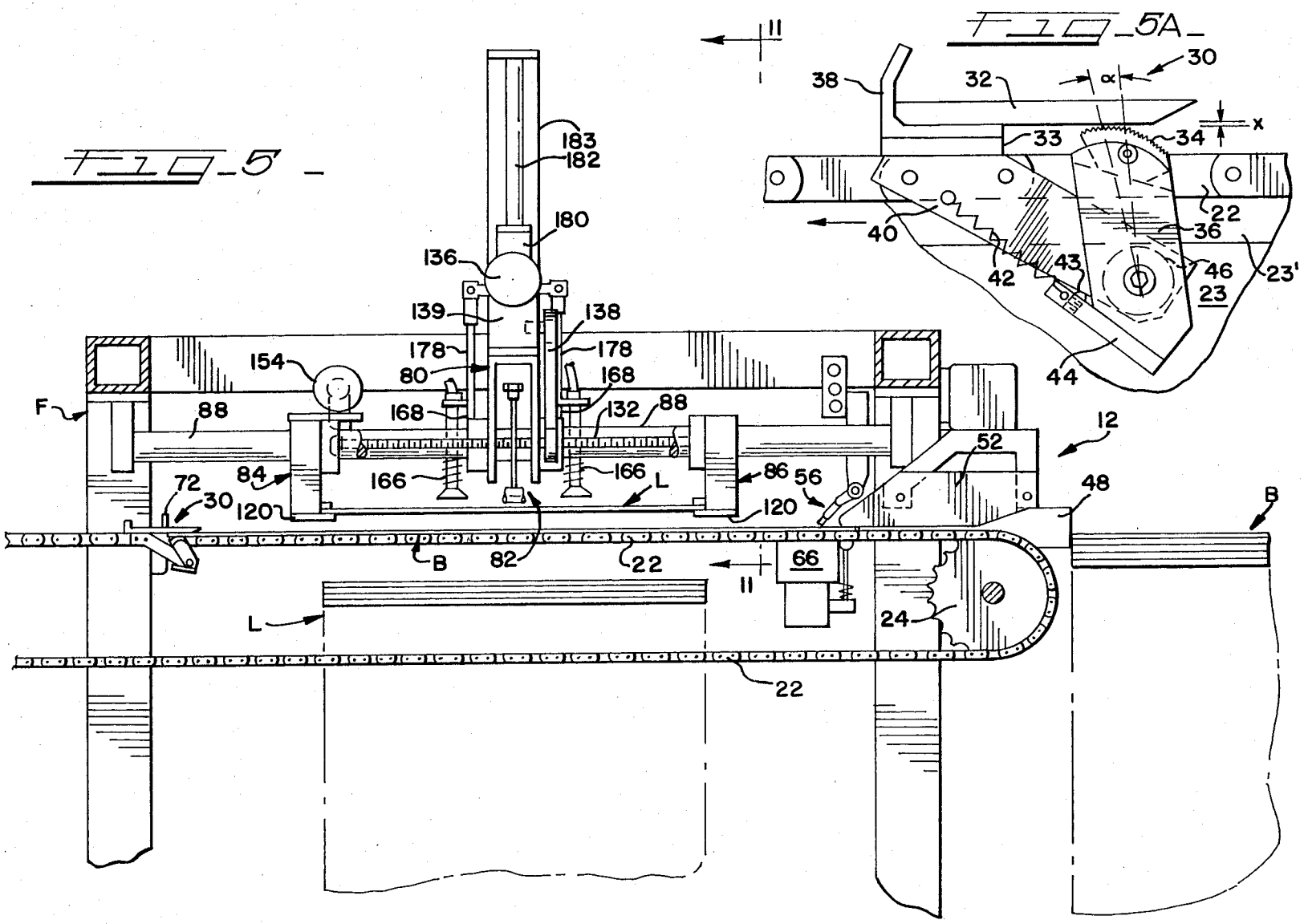
FIG. 5 is an elevational view of a liner lamination station of the present apparatus taken generally along line 5—5 of FIG. 1.
FIG. 5A is a side elevational view on a relatively enlarged scale of a gripper mechanism employed for transporting container blanks through the present apparatus.

Significantly, the body blank conveyor includes a plurality of spaced self-locking gripper assemblies 30 associated with each of the conveyor chains 22 preferably arranged in laterally spaced pairs on the chains 22. As shown in FIG. 5A, each gripper assembly 30 includes a jaw mechanism providing a wedge-like gripping action including an upper jaw member 32 and a lower jaw member 34 which together generally define a jaw cavity having a forward surface 33. In the preferred form, the gripper assemblies 30 are provided in adjacent pairs on each of the conveyor chains 22, with each pair of grippers on one of the chains being laterally aligned with a pair of the grippers on the other of the chains. By this arrangement, the leading edge of a body blank being advanced along the work path of the apparatus is securely received within the jaw mechanisms of each of the laterally aligned pairs of the grippers for indexing advancement of the body blank along the work path.

Each jaw 34 of each gripper assembly 30 is fixedly secured to the upper end of a pivotally mounted arm 36. Jaw 34 of each gripper includes an arcuate toothed gripping surface which cooperates with the lower surface of the respective upper jaw 32 for receiving and securely holding the leading edge of a body blank B.

Each gripper assembly 30 includes a generally L-shaped abutment member 38 positioned forwardly of upper jaw member 32. Upper jaw member 32 and abutment member 38 are joined to an inclined bracket 40 which is secured to the respective conveyor chain 22. Gripper pivot arm 36 of each gripper assembly 30 is pivotally mounted at the lower end of bracket 40 for effecting opening and closing of the gripper jaw mechanism. A tension spring 42 spring-loads the gripper pivot arm 36 for urging the toothed surface of lower jaw 34 toward upper jaw 32 for a "self-locking" gripping action. Acceleration of a blank body during conveyor indexing acts to tighten the grip of the gripper jaw mechanism, thus effecting the desired advancement of the blank.

It is preferred that the toothed lower jaw 34 of each gripper 30 not contact the lower surface of its respective upper jaw 32, as indicated by gap "X" in FIG. 5A, which illustrates the jaw mechanism in its most-closed position. An adjustable stop member 43 permits adjustment of the gap "X" in a preferred range of 0.010–0.025 inches.

Each gripper assembly includes a cam plate 44 secured to pivot arm 36, with the stop member 43 positioned in the cam plate 44 arranged to contact inclined bracket 40 when the jaw mechanism is in its closed condition. As will be further described, engagement of cam plate 44 of each gripper assembly against suitable cam means as conveyor chains 22 are advanced acts to open the jaw mechanisms of the grippers for release of the leading edge of a body blank.

As will be noted, the arrangement of upper jaw 32 and the toothed surface of lower jaw 34 of each gripper is such that the leading edge of a body blank loaded into the gripper mechanisms at blank feed end 12 acts to open each jaw mechanism against the action of its respective spring 44, with the action of the spring thereafter acting to securely retain the leading edge of the blank in position within the gripper assembly. In this regard, it is preferred that the arcuate toothed surface of lower jaw 34 "merge" into the trailing edge of pivot arm 36, and that the toothed jaw extend to a position below the horizontal work path of blanks being conveyed through the apparatus in order to minimize inadvertent "catching" of the leading edge of a body blank on the lower jaw or pivot arm 36. Guided movement of gripper assemblies 30 along chain guides 23 is facilitated by engagement of bushings 46 with the lower side of portions 23' of chain guides 23.

Figure 10:
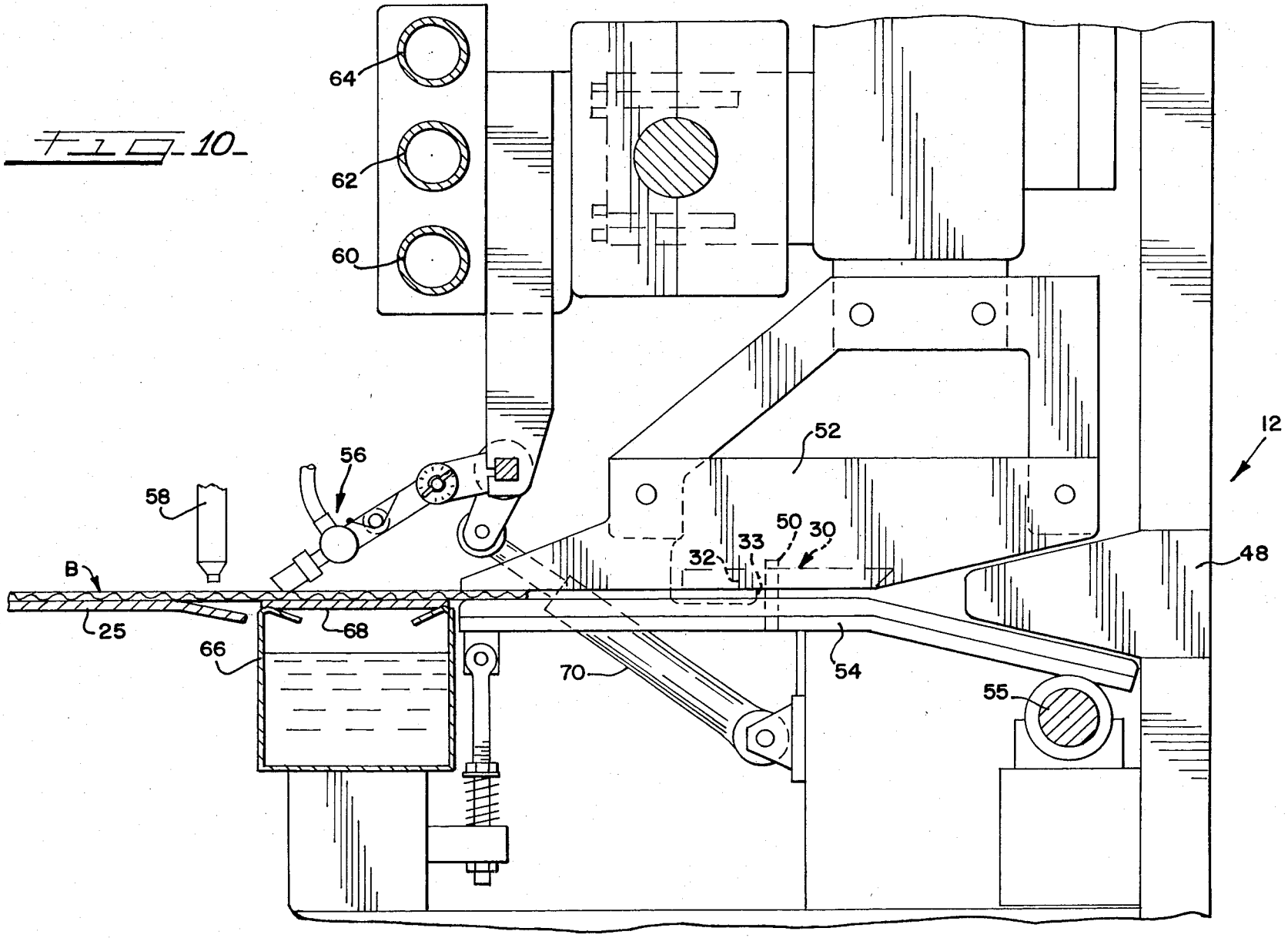
FIG. 10 is a view taken along line 10—10 of FIG. 1 illustrating an arrangement for applying adhesive to a container body blank prior to lamination of a liner thereto.
Figures 11, 12:
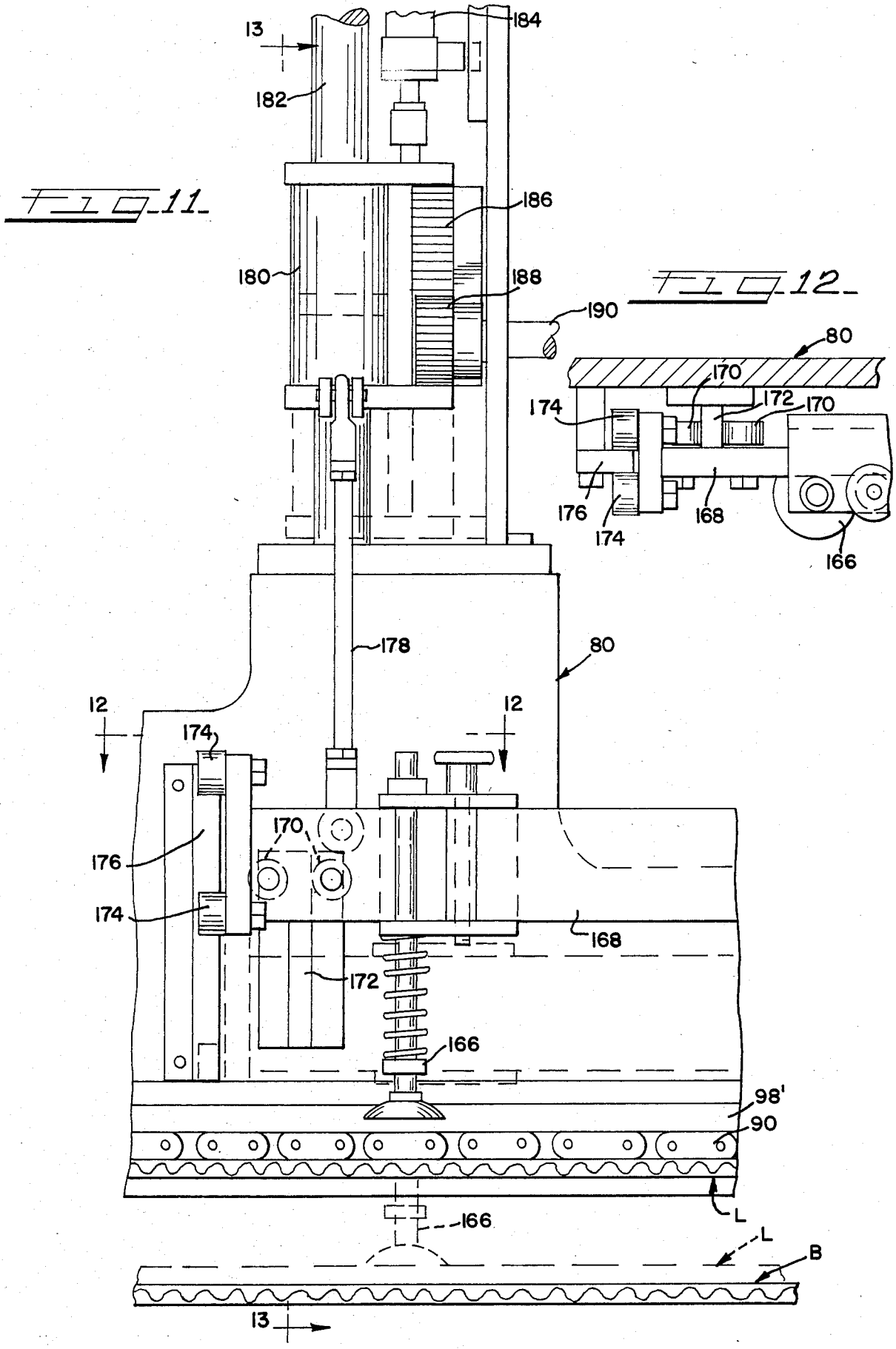
FIG. 11 is a view taken along line 11—11 of FIG. 5 illustrating vertically movable vacuum applying means for lowering a liner into superposition onto a body blank.
FIG. 12 is a view taken along line 12—12 of FIG. 11.

With particular reference to FIGS. 5 and 10, loading of a body blank B into apparatus 10 for lamination of a liner thereto will be described. As will be appreciated, the manner in which a body blank is loaded for folding and gluing without liner lamination is substantially similar, except that application of adhesive to the body blank is effected only for purposes of forming an adhesive joint with flap portion J. The automatic controls for the body blank conveyor of the illustrated apparatus can be easily set to advance a loaded body blank directly through lamination station 16 when lamination is not to be effected.

The unfolded and scored body blanks B are very easily loaded one at a time from a lift table carrying a stack of body blanks into blank loading end 12 of the apparatus. In this regard, a side guide 48 is preferably provided against which an edge portion of the blank being loaded can be positioned to facilitate the correct positioning of the body blank so that it is correctly received by the jaw mechanisms of each pair of gripper assemblies 30 on each of the spaced apart conveyor chains 22.

Figure 20:
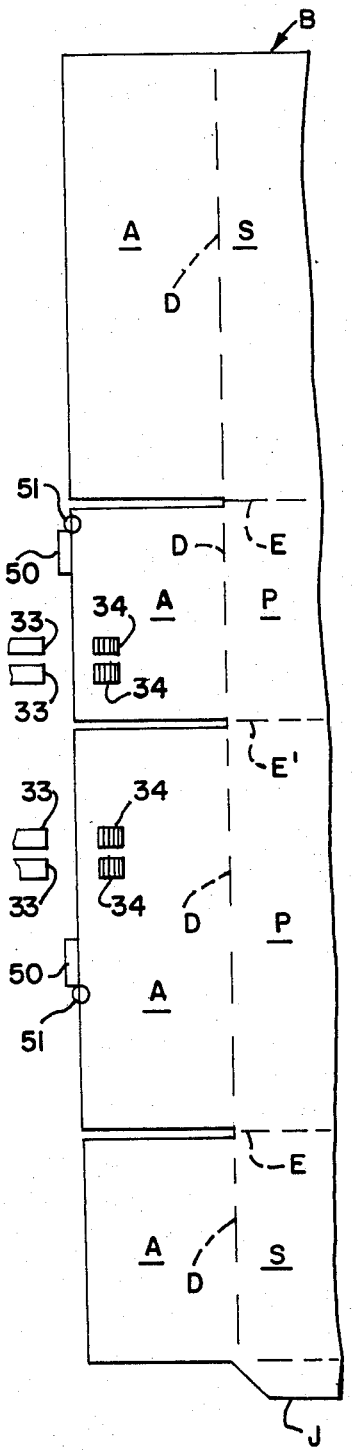
FIG. 20 is a diagrammatic view illustrating loading of a container body blank into the present apparatus.

To further facilitate correct positioning of the body blank in the gripper assemblies, an arrangement of preferably two laterally spaced vertically movable stops 50 is provided. Stops 50 may be configured for up-and-down vertical movement, or for vertical movement such as by rotation or parallelogrammatic movement. As illustrated diagrammatically in FIG. 20, stops 50 are positioned with respect to the pairs of gripper assemblies 30 on each conveyor chain 22 such that when the gripper assemblies are positioned for receiving the leading edge of the body blank, the leading edge is spaced from and does not contact surface 33 of the jaw cavity of each gripper. Stops 50 are controlled to remain in their up positions to prevent blank loading until grippers 30 are positioned for receiving a blank.

Each of the stops 50 has a photo-electric sensor 51 or like sensing means positioned in close association therewith so that indexing of the blank by the body blank conveyor will not occur until the sensors detect simultaneous engagement of the leading edge of the blank with both of the stops 50. This feature of the present apparatus facilitates "squaring up" of the body blank with respect to the straight-line work path through the apparatus such that the parallel score lines E of the body blank are disposed in parallel relation to the work path. It will be noted that in FIG. 10 a gripper assembly 30 is illustrated in phantom line to show the relative positioning of the gripper assemblies 30 with respect to the stops 50 when the grippers are stopped and positioned for receiving a blank being loaded.

Since adhesive is to be applied to the upper surface of the body blank as the blank is indexed into the lamination station 16, sensing means as will be further described is provided for sensing the disposition of a liner L in the lamination station in either (1) a position for advancement by its respective liner conveyor, or (2) position for lowering the liner into superposition on the body blank. Presuming that a liner is in one of such positions, with simultaneous engagement of the leading edge of the body blank with stops 50 as described above, the body blank conveyor is indexed to advance the blank into the lamination station. As the blank is advanced, it is held against a plurality of laterally spaced, vertically fixed upper guides 52 by a plurality of laterally spaced, spring-loaded lower guides 54, with each of the lower guides 54 being pivotal about a pivot shaft 55. By this arrangement, the body blank is firmly held in position for receiving adhesive for lamination of a liner thereto.

In order to effect lamination, a combination of a cold set adhesive and a hot melt adhesive is preferably employed. The hot melt adhesive will provide a quick "tack" for maintaining the liner in registry with the body blank during indexing to the folding station 18 and subsequent folding at folding station 18. While the cold set adhesive cures more slowly than the hot melt adhesive, the combination of hot melt and cold set adhesives permits the utilization of a very small amount of the relatively expensive hot melt adhesive, while providing highly effective lamination of the liner to the body blank.

In the illustrated embodiment, a plurality of cold set adhesive applying heads 56 are provided in laterally spaced relation above the work path of the body blank. Hot melt adhesive applying heads 58 are likewise provided, but with only a pair of the hot melt heads preferably being employed.

As illustrated in FIG. 3, hot melt adhesive M is preferably applied to panel portions P of the blank just inwardly of the score lines E (about which the blank will be subsequently folded) and/or just over the centerline of the body blank conveyor. In distinction, a pattern of cold set adhesive N is preferably applied substantially throughout each of the panels P and S of the body blank. Since only the panel portions of the body blank will ordinarily receive liner L, adhesive is not ordinarily applied to end flaps A and C of the body blank.

Figure 22:
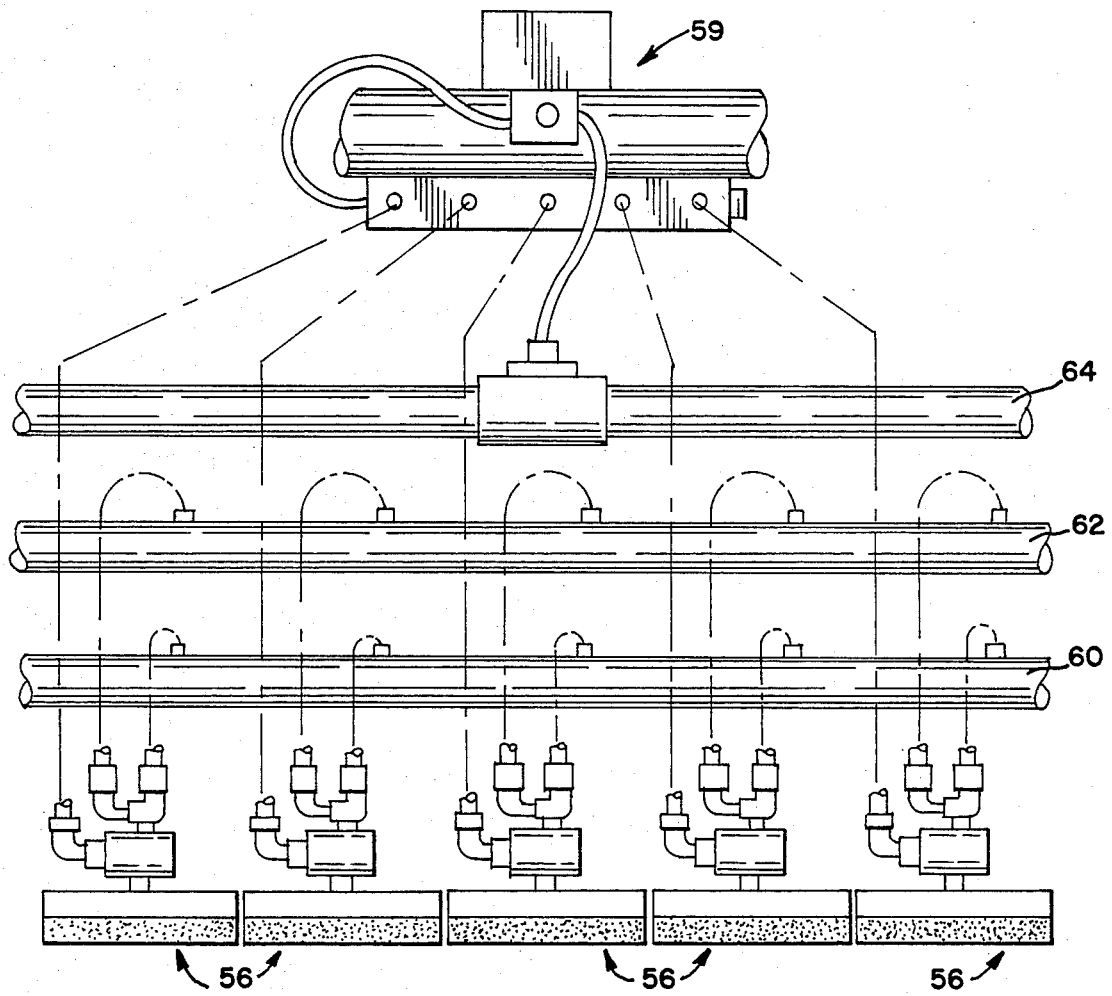
FIG. 22 is a diagrammatic view further illustrating the means for applying adhesive to a body blank, as shown in FIG. 10.

With reference to FIG. 10, and FIG. 22 which diagrammatically illustrates cold set adhesive applying heads 56, automatic controls 59 are preferably provided for operation of cold set adhesive heads 56. The controls are responsive to sensing arrangements operatively associated with the body blank conveyor. Control of cold set as well as hot melt adhesive application is obtained by detecting the position of the leading edge of the body blank as it begins to index, with a pulse counter operatively associated with the blank conveyor to provide an accurate signal reflective of the location of the leading edge at all times during indexing movement. In this manner, the adhesive applying means are operated to only apply glue on the desired portions of the body blank (ordinarily panel portions S and P), with the accuracy that can be achieved desirably avoiding waste of adhesive. Indexing of the body blank at an essentially constant speed during adhesive application acts to assure even distribution.

Cold set adhesive applying heads 56 have been illustrated as so-called contact extrusion heads (i.e., contact with the surface of the body blank is required for application of adhesive thereto). Versatile and reliable operation of the present apparatus is achieved by mounting the cold set heads 56 for movement together, into any of three positions. Adhesive for the heads 56 is provided from adhesive supply means 60, while water for flushing the heads is provided from water supply means 62. Air supply means 64 supplies pressure for extrusion of the adhesive. Controls 59 operate to regulate the supply of water or adhesive to the heads 56.

FIG. 10 illustrates heads 56 in position for applying adhesive to the body blank, with the heads spring-loaded in a downward direction into contact with the body blank. When apparatus 10 is to be used for folding and gluing body blanks only (without liner lamination), the heads 56 can be raised to a non-use position. When the apparatus is not running, the heads 56 can be lowered into a head cleaning water tank 66, and the heads flushed with water from water supply means 62. Laterally spaced bridges 68 (positioned between adjacent ones of the heads 56) act to support the body blank B as it is indexed by the blank conveyor. Means such as fluid ram 70 are provided for moving the heads 56 in unison, such as by mounting on a common shaft, between their raised, adhesive-applying, and washing positions. Check valves built into the cold set adhesive applying system prevent water from being forced into the glue lines during flushing, and similarly prevent glue from being forced into the water lines during adhesive application. Immersion of the heads 56 in cleaning tank 66 prevents the adhesive from drying in the heads, which could otherwise interfere with their correct operation.

As will be appreciated, accurate registration of a liner L with the body blank B calls for the body blank to be "square" with respect to the body blank work path such that the score lines E of the body blank are parallel to the work path. Accordingly, a pair of vertically movable, laterally spaced stops 72 (which may be similar to stops 50) having respective sensing means 73 are preferably provided along the body blank work path for engagement with the leading edge of the body blank B as it is indexed into position for lamination of liner L thereto (see FIGS. 1 and 5).

Figure 21:
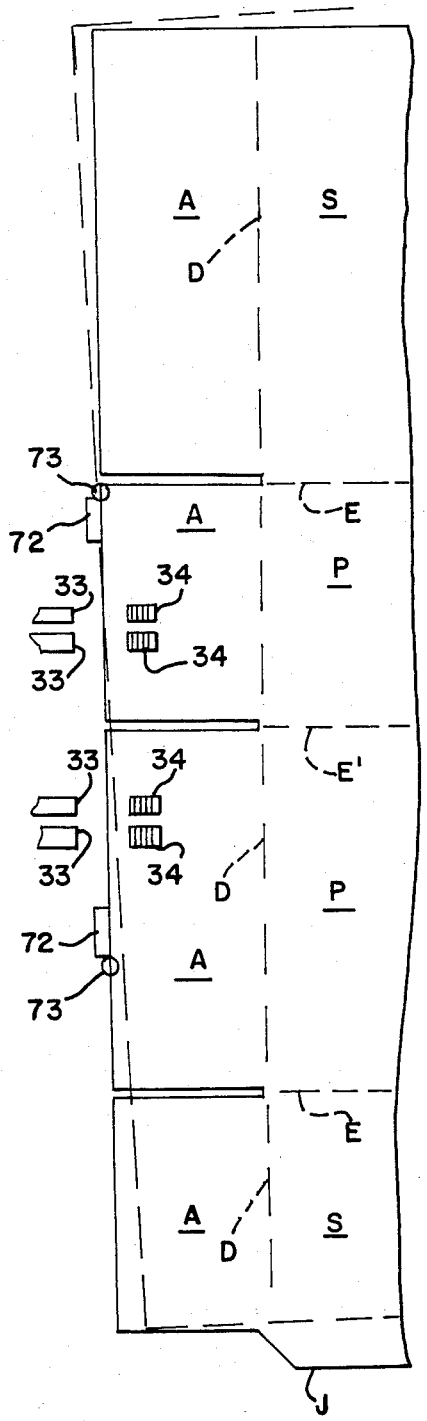
FIG. 21 is a diagrammatic view illustrating orientation of a container body blank at right angles to the work path of the present apparatus for subsequent lamination of a liner thereto.

As diagramatically illustrated in FIG. 21, stops 72 and their associated sensors function to effect a final "square up" of the body blank just prior to lamination of liner L thereto. The sensors 73 associated with the stops 72 act to control the indexing movement of the body blank conveyor. Specifically, as the body blank is moved at "slow" or low indexing speed, the sensors do not stop indexing movement of the conveyor until simultaneous engagement of the leading edge of the body blank with both of the stops 72 is sensed. In order to permit such simultaneous engagement if the body blank is not already arranged at right angles to the work path, grippers 30 of the blank conveyor have been specifically configured to permit limited withdrawal of the leading edge therefrom until simultaneous engagement of the leading edge with stop 72 is sensed. Limited withdrawal of the leading edge from one pair of the grippers 30 or the other is accommodated by providing the gripper assemblies 30 with a locking angle "alpha" on the order of 20 degrees (FIG. 5A).

The arrangement for moving a liner L transversely or perpendicularly to the body blank work path for lamination to the body blank B will next be described. Generally, this arrangement comprises a central beam 80 which carries a liner conveyor 82 which is substantially similar in many respects to the previously described body blank conveyor, and a pair of support rails 84 and 86 arranged on respective opposite sides of the liner conveyor. The support rails 84 and 86 are configured to releasably support and confine the opposite edges of a liner L as the liner is advanced by the conveyor 82 into a position above the work path of body blank B for lamination to the body blank. For purposes of highly versatile adjustability, central beam 80 (which carries the liner conveyor) and support rails 84 and 86 are all mounted on a pair of guide shafts 88 supported by frame F for movement of the central beam and the support rails and in a direction parallel to the straight-line horizontal work path of body blank B.

A stack of liners L is positioned generally at the load end of conveyor 82 on a lift table or the like, and are fed in a manner similar to that of body blank B. An edge guide 83 (FIG. 1) facilitates correct positioning of the liners by an operator for accurate loading.

Liner conveyor 82 is substantially similarly configured to one of the two chain and gripper arrangements of the body blank conveyor, except that the lower run of the conveyor 82 is configured for liner advancement. Accordingly, the liner conveyor includes an endless roller link liner conveyor chain 90 which is entrained about a pair of sprockets 92 and 94 mounted on beam 80. A liner conveyor motor 96 is operatively connected with the sprocket 94 to drive the liner conveyor intermittently, with advancement of a liner L into position above the body blank work path being effected during a single high/low speed index of liner conveyor 82.

Figure 16:
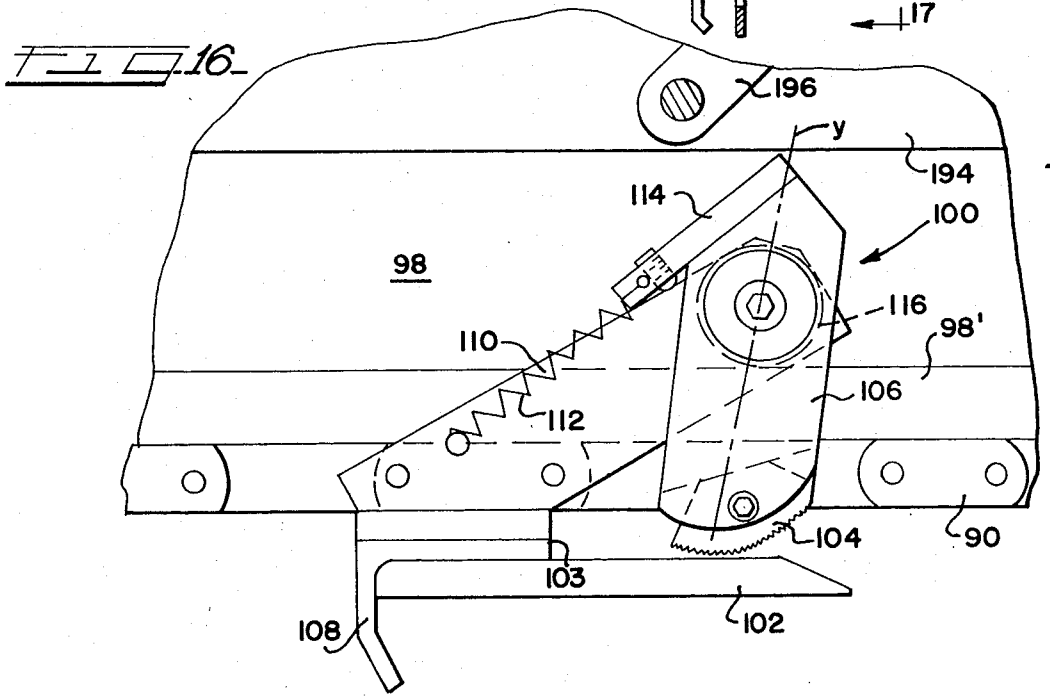
FIG. 16 is an enlarged side view of a liner conveyor gripper mechanism.
Figure 17:
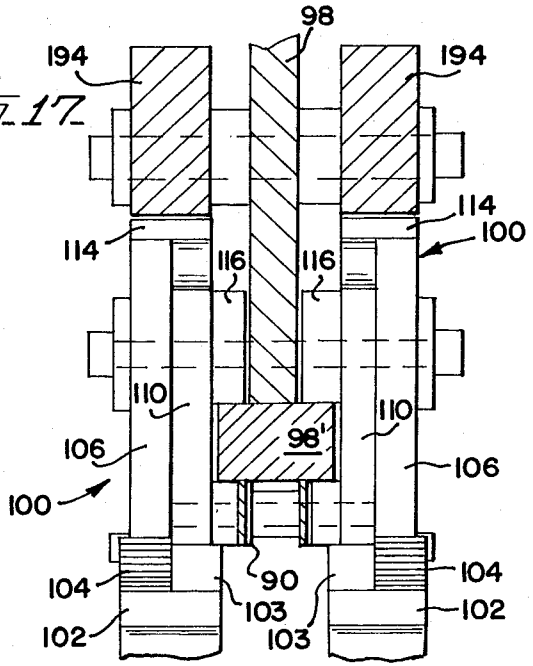
FIG. 17 is a cross-sectional view taken generally along line 17—17 of FIG. 15.

As noted, liner conveyor 82 is substantially similar in configuration to one of the blank conveyor chains 22 and its associated gripper assemblies 30. As best shown in FIGS. 16 and 17, liner conveyor chain 90 is guided about a chain guide plate 98 having an outer portion 98'. The liner conveyor includes two pairs of gripper assemblies 100 such that while one pair of the gripper assemblies is advancing a liner L along the lower run of the conveyor for advancing a liner L into position for lamination to a body blank, the other pair of grippers 100 is returning along the upper run of the liner conveyor toward the liner load end of the conveyor for receiving the next liner to be loaded into the apparatus.

Grippers 100 of the liner conveyor are adapted to receive and securely hold the leading edge of liner L. Each gripper assembly 100 includes a jaw member 102 and a cooperating toothed jaw number 104 which together grip the leading edge of the liner L, with each gripper including a stop surface 103 at the forward end of the jaw cavity against which the leading edge of a liner is positioned during loading. Jaw member 104 is fixed to a gripper pivot arm 106 which pivots for opening and closing the jaw mechanism of the gripper.

Each gripper assembly 100 further includes an abutment member 108, which together with jaw member 102, is joined to an inclined bracket 100 connected to conveyor chain 90. The gripper pivot arm 106 is pivotally mounted on the inclined bracket, 100 with a tension spring 112 biasing pivot arm 106 so that the jaw mechanism of the gripper is urged into a closed configuration, as shown in FIG. 16. Opening of the jaw mechanism is effected via a cam plate 114 joined to the pivot arm 106, with each gripper assembly including a bushing 116 engagable with outer portion 98' of chain guide plate 98 for guiding the movement of the gripper assemblies as conveyor chain 90 is indexed.

Figures 13, 14:
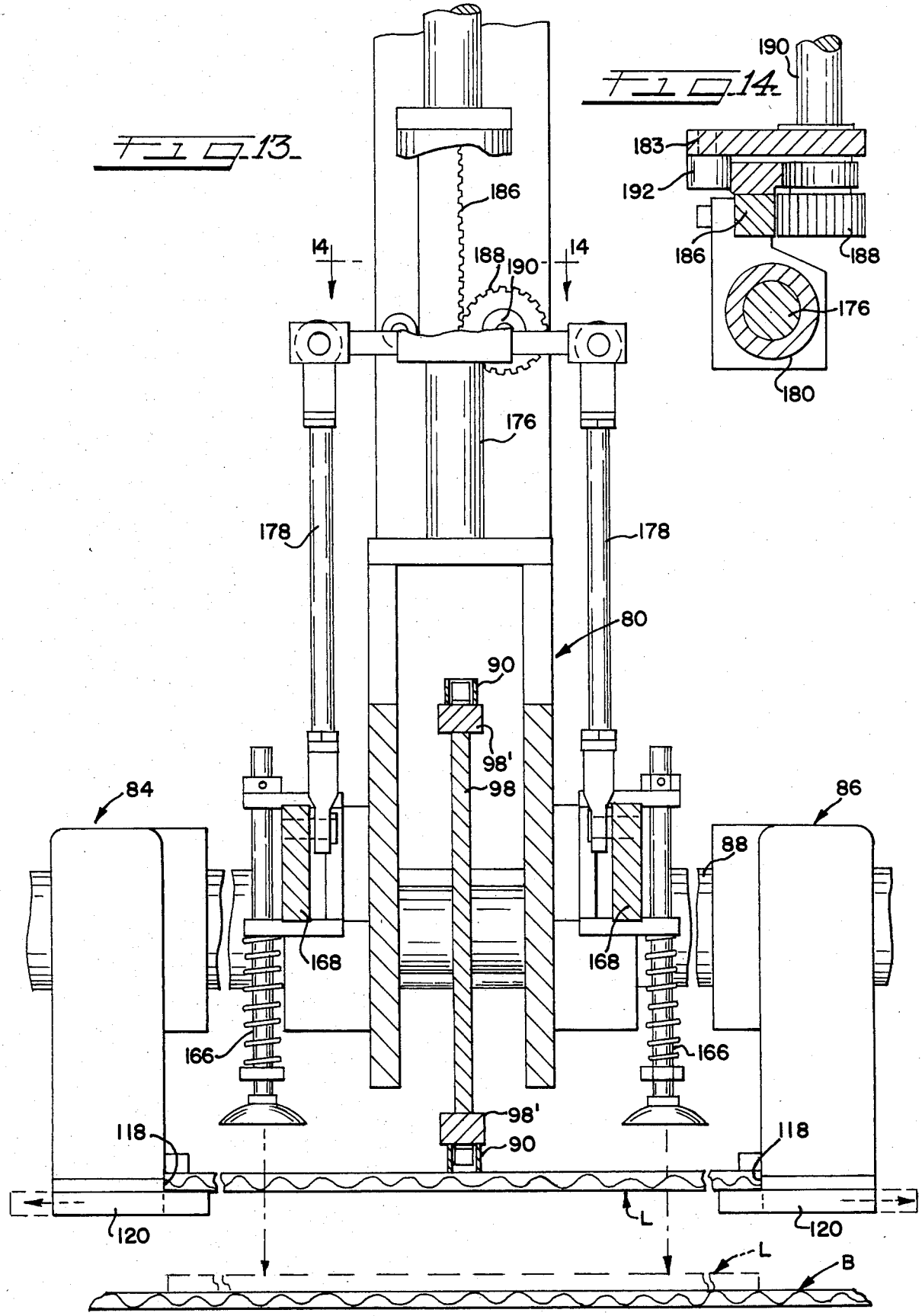
FIG. 13 is a view further illustrating the arrangement for lowering a liner into superposition on a body blank taken along line 13—13 of FIG. 11.
FIG. 14 is a view taken along line 14—14 of FIG. 13.

As a liner L is advanced into position above the body blank work path for lamination to a body blank, guided advancement of the liner is provided by the parallel support rails 84 and 86. To this end, each of the support rails is configured to support and confine an edge portion of the liner. As shown in FIG. 13, each support rail 84 and 86 defines a channel 118 generally at the lower edge thereof, with each channel 118 in part being defined by a retractable, outwardly movable release plate 120. Release plates 120 act to support the liner while it is being advanced by liner conveyor 82, with the release plates 120 being moved outwardly once the liner has been indexed to its stopped position to permit the liner to be lowered onto a body blank for lamination.

Figure 7A:
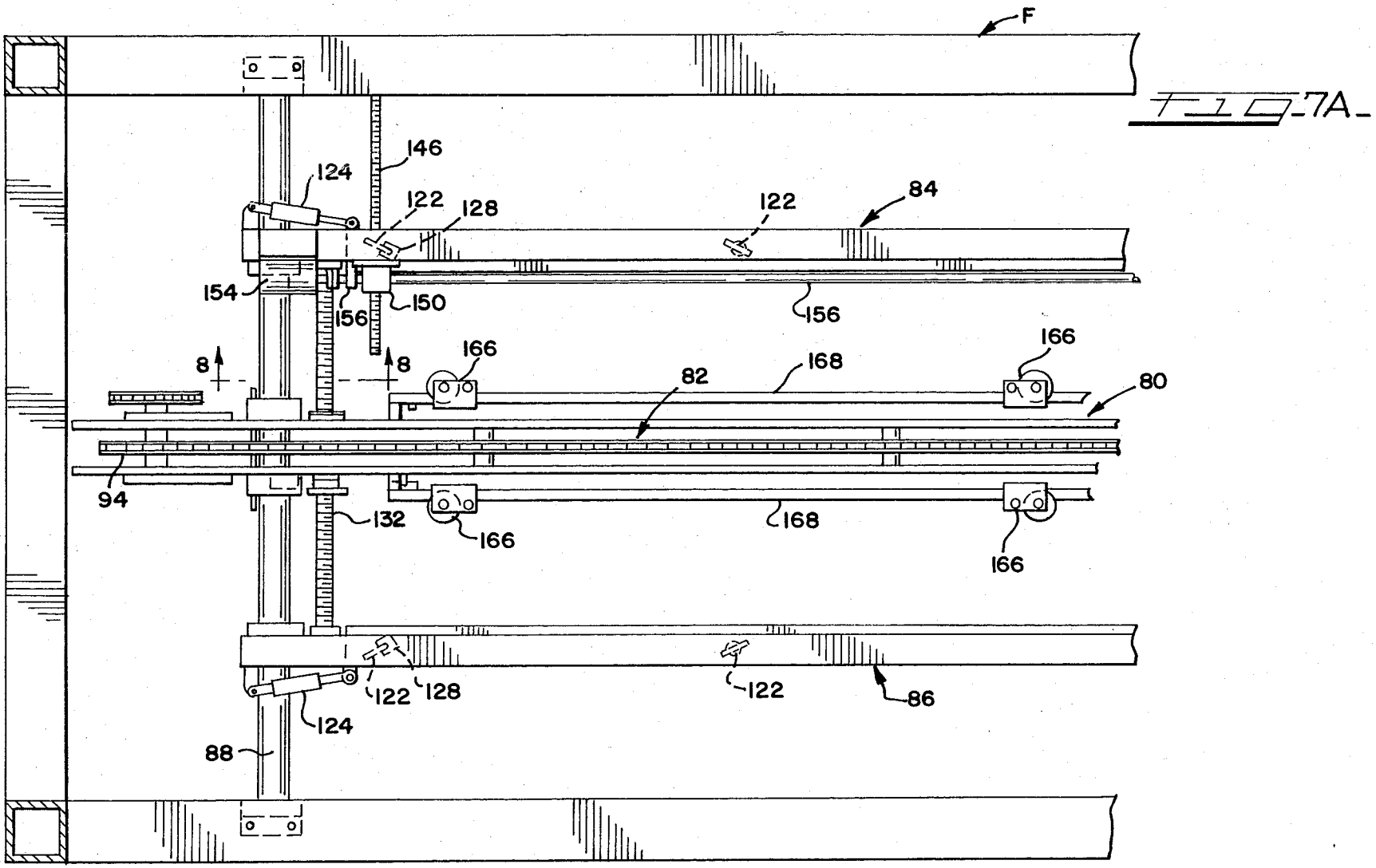
FIGS. 7A and 7B are plan views, partially in cross-section, of the liner lamination station of the present apparatus, respectively taken along line 7A—7A of FIG. 6A, and line 7B—7B of FIG. 6B.
Figure 7B:
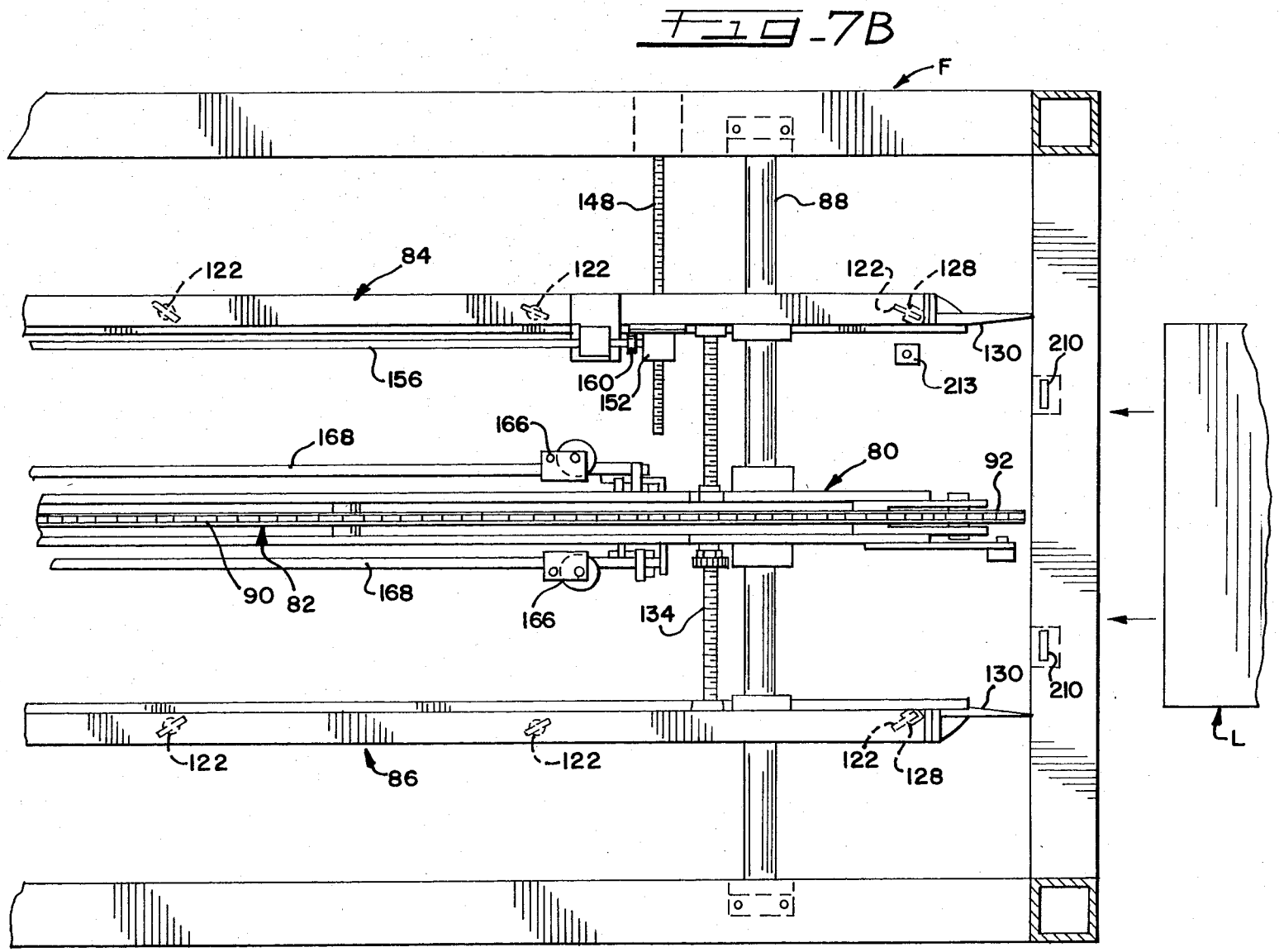
Figure 9:
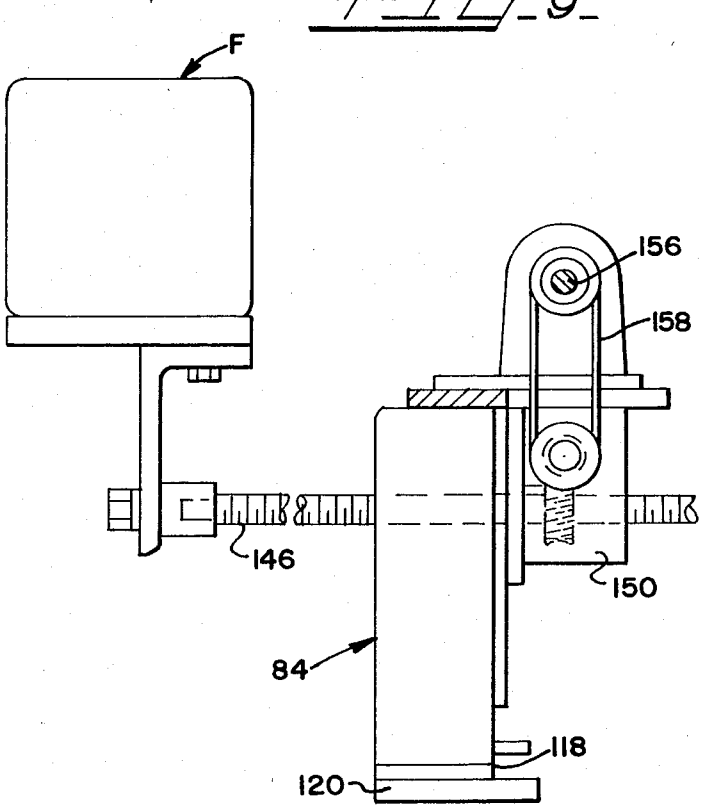
FIG. 9 is a view taken along line 9—9 of FIG. 8.
Figure 8:
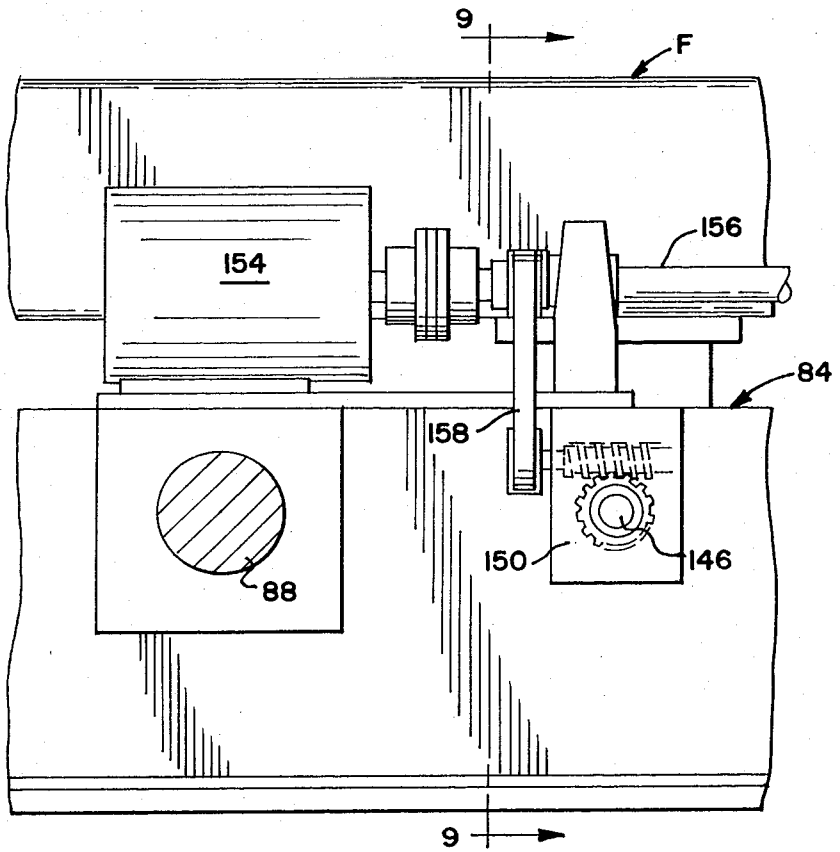
FIG. 8 is a view taken along line 8—8 of FIG. 7A.
Figure 18:
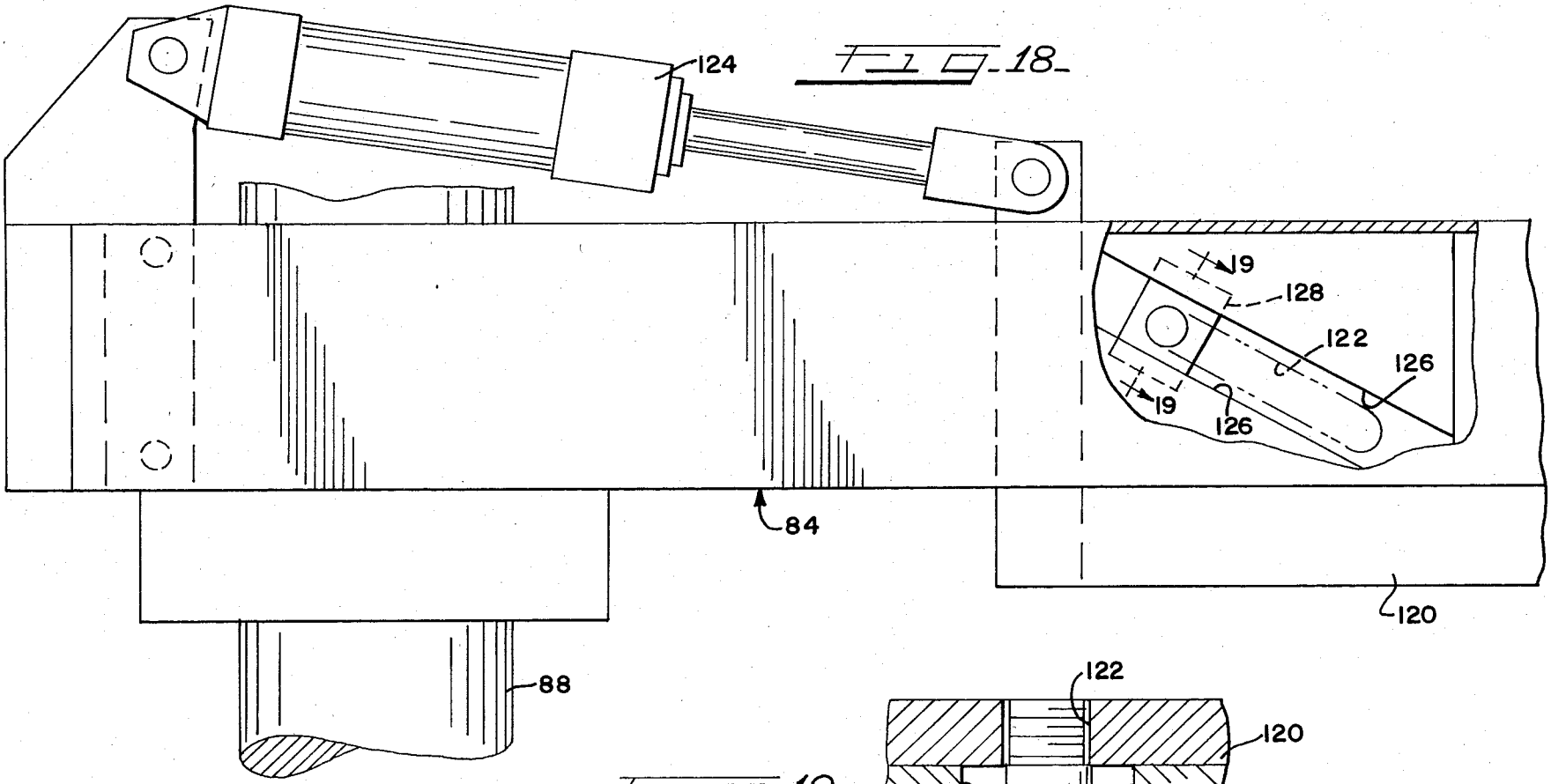
FIG. 18 illustrates, with a portion thereof broken away, a portion of an arrangement for releasably supporting a liner for subsequent lamination to a body blank.
Figure 19:
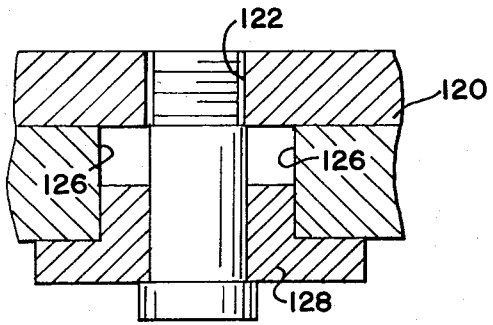
FIG. 19 is a cross-sectional view taken along line 19—19 of FIG. 18.

In the illustrated embodiment, release plates 120 each define a plurality of angle slots 122 (FIGS. 7A and 7B) with suitable headed members provided which extend through the angle slots for slidably supporting each release plate 120 for outward angular movement. Suitable double-acting fluid release rams 124 are operatively connected to each of the release plates 120 for effecting the desired outward movement thereof for releasing a liner from the channels 118 of the support rails. In order to provide a smooth release action, each end of each release plate 120 can be formed with bearing surfaces 126 (FIGS. 18 and 19) parallel to the associated angle slot 122, with a suitably machined headed support 128 cooperating with the bearing surfaces 126 to provide smooth movement of the release plates. As shown in FIG. 7B, each support rail 84 and 86 preferably includes a side guide 130 to facilitate loading of a liner L into the apparatus by an operator.

One of the principle features of the present apparatus is its versatility for folding, gluing, and laminating a wide range of differently sized container blanks. To this end, the apparatus includes an arrangement for selectively adjusting the spacing between the parallel support rails 84 and 86 for accommodating liners of different widths, as well as an arrangement for moving the support rails and liner conveyor 82 in unison in a direction parallel to the body blank work path to facilitate correct positioning of the liner on the panel portions of the body blank.

With particular reference to FIGS. 6A, 6B, 7A, 7B, adjustable spacing of the support rails 84 and 86 is effected through means of a pair of threaded shafts 132 and 134 rotatably supported on central beam 80, with each of the shafts including right-hand and left-hand threaded portions. The shafts 132 and 134 are suitably threadably joined to support rails 84 and 86 such that concurrent rotation of the shafts 132 and 134 acts to move the central beam 80 and the support rail 86 toward or away from support rail 84 (which remains spatially fixed), with the central beam 80 remaining in equally spaced relation to the support rails. Guided movement of the support rail 86 and the central beam 80 in this manner is accommodated by support of the rails on guide shafts 88 carried by frame F.

Figure 6A:
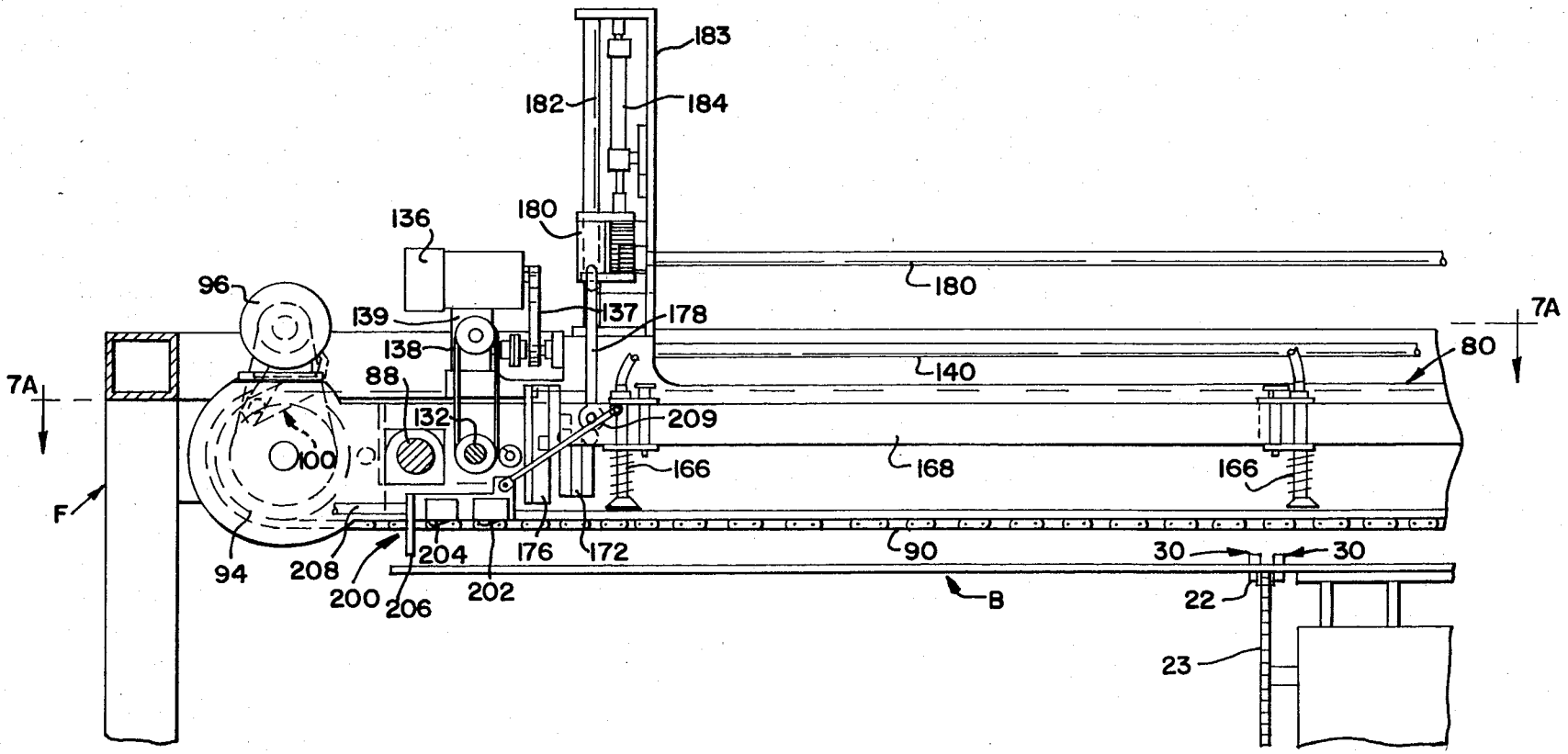
FIGS. 6A and 6B are elevational views taken respectively along line 6A—6A and line 6B—6B of FIG. 1, further illustrating the liner lamination station of the present apparatus.

An adjustment drive motor 136 is mounted on central beam 80 for effecting powered adjustment of the spacing between the support rails 84 and 86. Motor 136 is operatively connected by a belt 137 with a right-angle gear drive 138, which in turn is operatively connected with threaded shaft 132 by a suitable belt 138 (FIGS. 5, 6A). Power is supplied from motor 136 to the other threaded shaft 134 via a connecting shaft 140 extending generally along the length of central beam 80. Connecting shaft 140 operates through a right-angle gear drive 142 (FIG. 6B), which in turn is suitably connected to threaded shaft 134 via a belt 144. Thus, operation of motor 136 acts to move the support rail 86 and central beam 80 toward or away from support rail 84, with the support rails maintained in equally spaced parallel relation to central beam 80 and liner conveyor 82.

As noted, the present apparatus further includes means for moving the support rails 84 and 86, and central beam 80 with liner conveyor 82 carried thereby, together in unison in a direction parallel to the direction of travel of a body blank through the apparatus. To this end, a pair of threaded shafts 146 and 148 extend from frame F, and are respectively operatively connected to a pair of screw drives 150 and 152 mounted on support rail 84 (see FIGS. 7A, 7B, 8, and 9).

Concurrent operation of screw drives 150 and 152 is effected by a drive motor 154 mounted on support rail 84. The drive motor 154 is operatively connected with a connecting shaft 156 which extends generally along the length of support rail 84. Drive belts 158 and 160 respectively operatively connect the screw drives 150 and 152 to the connecting shaft 156 such that operation of motor 154 operates the screw drives 150 and 152 in unison. By this action, support rail 84 is moved along guide shafts 88, with the connection of support rail 84 to central beam 80 and support rail 86 via threaded shafts 132 and 134 resulting in movement of the support rails and the liner conveyor 82 along the guide shafts 88. As will be appreciated, the relative spacing of the support rails 84 and 86 is maintained during this action, as is the relative spacing between the support rails and the liner conveyor. This adjustment arrangement facilitates very convenient adjustment of the position of a liner with respect to the body blank work path for highly accurate superposition of the liner on the panel portions of a body blank.

As previously noted, liner conveyor 82 advances a liner L into a horizontally fixed, stopped position wherein the liner is held by support rails 84 and 86 for subsequent lowering into superposition onto a body blank at the lamination station. In order to effect this lowering of the liner after release of its edge portions from support rails 84 and 86, the present apparatus includes an arrangement of vertically movable vacuum-applying cups which are operated in timed relation to the release of the liner from support rails 84 and 86.

As shown in FIGS. 11–14, a plurality of vacuum cup assemblies 166 are provided in operative association with central beam 80 which carries liner conveyor 82. As illustrated, each of the vacuum cups 166 is mounted for selective positioning along a respective one of a pair of vertically movable mounting rails 168 which are positioned on respective opposite sides of the central beam 80. In order to assure smooth vertical movement of the mounting rails 168, each end of each mounting rail is provided with a pair of rollers 170 for engaging a guide 172, and two pairs of rollers 174 for engaging a guide 176. As shown, vacuum cups 166 are carried by a spring-loaded arrangement on the respective one of mounting rails 168 to permit limited upward movement of each vacuum cup against the action of its respective biasing spring. This arrangement permits a liner to be lowered onto a body blank, with limited downward movement of mounting rails 168 taking place after the liner contacts the blank so that the biasing springs of the vacuum cups 166 urge the cups downwardly to apply pressure to the liner for the desired adhesion by the adhesive previously applied to the body blank.

In order to effect concurrent and coordinated vertical movement of mounting rails 168, and thus vacuum cups 166, a pair of tie rods 178 are respectively joined to the opposite ends of the mounting rails. The tie rods 178 are in turn joined to lift members 180 respectively mounted for vertical movement on vertical guides 182. The vertical guides 182 are maintained in position on top of central beam 80 with respective upright supports 183. Vertical movement of the lift members 180, and thus the vacuum cups 166, is effected via a pair of double-acting fluid rams 184 respectively mounted on upright supports 183, and respectively operatively joined to lift members 180.

Since it is desired that the lift members 180 are operated in unison by the cylinders 184, a gear rack 186 is joined to each lift member. Each rack 186 engages a respective gear pinion 188, with the gear pinions 188 fixed to opposite ends of an equalization shaft 190. Back-up rollers 192 respectively mounted on upright supports 183 engage a rear surface of the respective gear rack 186, thus assuring that the racks and pinions are maintained in engagement.

During lowering of a liner L into superposition onto a body blank in the work path, vacuum cups 166 are lowered in unison to apply vacuum to the upper surface of the liner as the liner is supported by support rails 84 and 86. During a dwell period in the vertical movement of the vacuum cups, release plates 120 of the support rails 84 and 86 are moved outwardly by their respective release cylinders 124, with the liner then gripped and supported by the vacuum cups 166. Since the liner L was moved into position by a pair of the grippers 100 of conveyor 82, and liner conveyor 82 then stopped, the leading edge of the liner must be released from the gripper assemblies before the liner can be lowered by vertical movement of vacuum cups 166.

Figure 15:
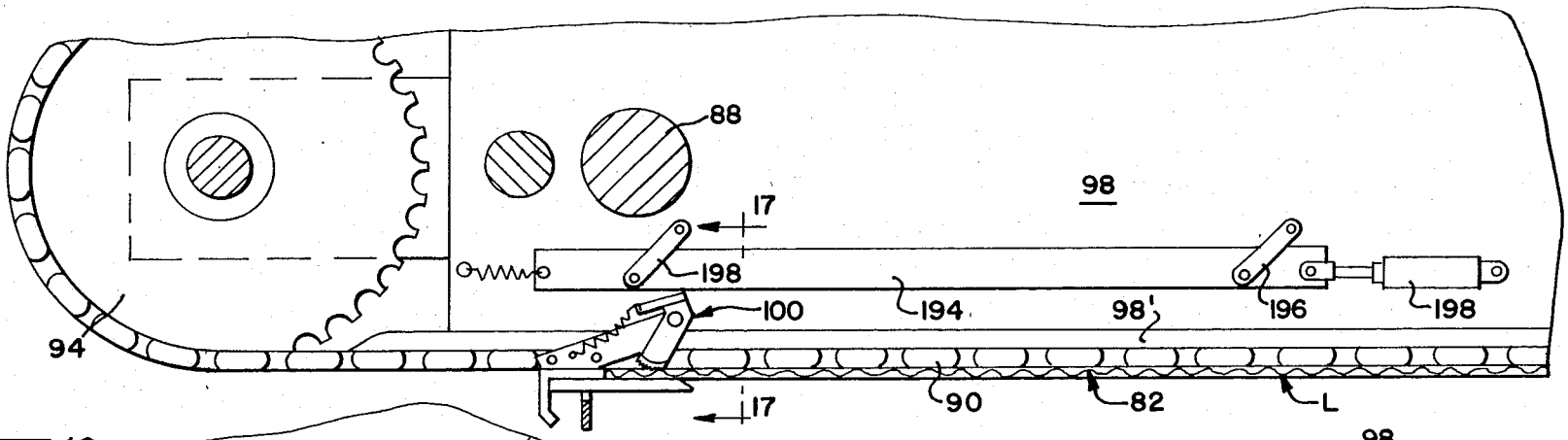
FIG. 15 is a view illustrating a portion of a liner conveyor for advancing a liner into position for lamination to a body blank.

In order to open the gripper mechanisms 100 for release of the leading edge of liner L, a pair of gripper release cam bars 194 (FIGS. 15 and 17) are mounted on respective opposite sides of chain guide plate 98 for respective engagement with cam plates 114 of the gripper mechanisms. Each cam bar 194 is mounted for arcuate, parallelogrammatic movement by cam mount links 196, with one or more suitable fluid rams 198 provided for effecting movement of the cam bars. Cam bars 194 are configured to act generally at right angles to the line "y" (FIG. 16) of locking force of the grippers 100 to effect a smooth and positive release action.

As will be noted, providing the cam bars 194 with an elongated configuration permits them to operate against the grippers 100 throughout a range of relative positions therebetween. This feature of the apparatus further facilitates its versatility since it permits the desired opening action for the conveyor grippers 100 even though the stopped position of the liner, and thus stopped position of the grippers 100, can vary depending upon the dimensions and configurations of the body blank B to which the liner is being applied.

The present apparatus includes a number of sensing arrangements for facilitating fully automated operation of the apparatus. One such arrangement is illustrated in FIG. 6A, and comprises a stop assembly 200 which operates liner conveyor 82 so that the leading edge of liner L is correctly positioned with respect to a body blank in the work path of the apparatus. The stop assembly 200 includes a "slow" sensor 202 and a "stop" sensor 204 which detect the leading edge of liner L as it is being advanced into position by conveyor 82, and operate through the automatic controls of the apparatus to first "slow" advancement of the conveyor, and thereafter "stop" advancement. Sensor 204 also provides a signal for operation of the body blank conveyor to indicate disposition of a liner in position for lamination.

A mechanical stop 206 is part of the stop assembly 200, and further facilitates accurate positioning of the leading edge of liner L for subsequent lamination by preventing advancement of the liner beyond stop 206. The preferred configuration of liner conveyor grippers 100 permits limited withdrawal of the leading edge of the liner to prevent deformation of the leading edge by the stop 206. In the preferred form, stop assembly 200 is adjustably mounted on a pair of supports including a powered lead screw (see support 208 in FIG. 6A) for powered movement in a direction along the line of liner advancement. Again, this adjustability facilitates highly versatile use of the present apparatus. In order to position two of the vacuum cups 166 as closely as possible to the leading edge of the liner for good support during liner lowering, a pair of springs 209 (one being shown) can be provided to connect the end-most pair of the cups 166 with the movable stop assembly 200 for movement of the cups with the assembly.

Figure 6B:
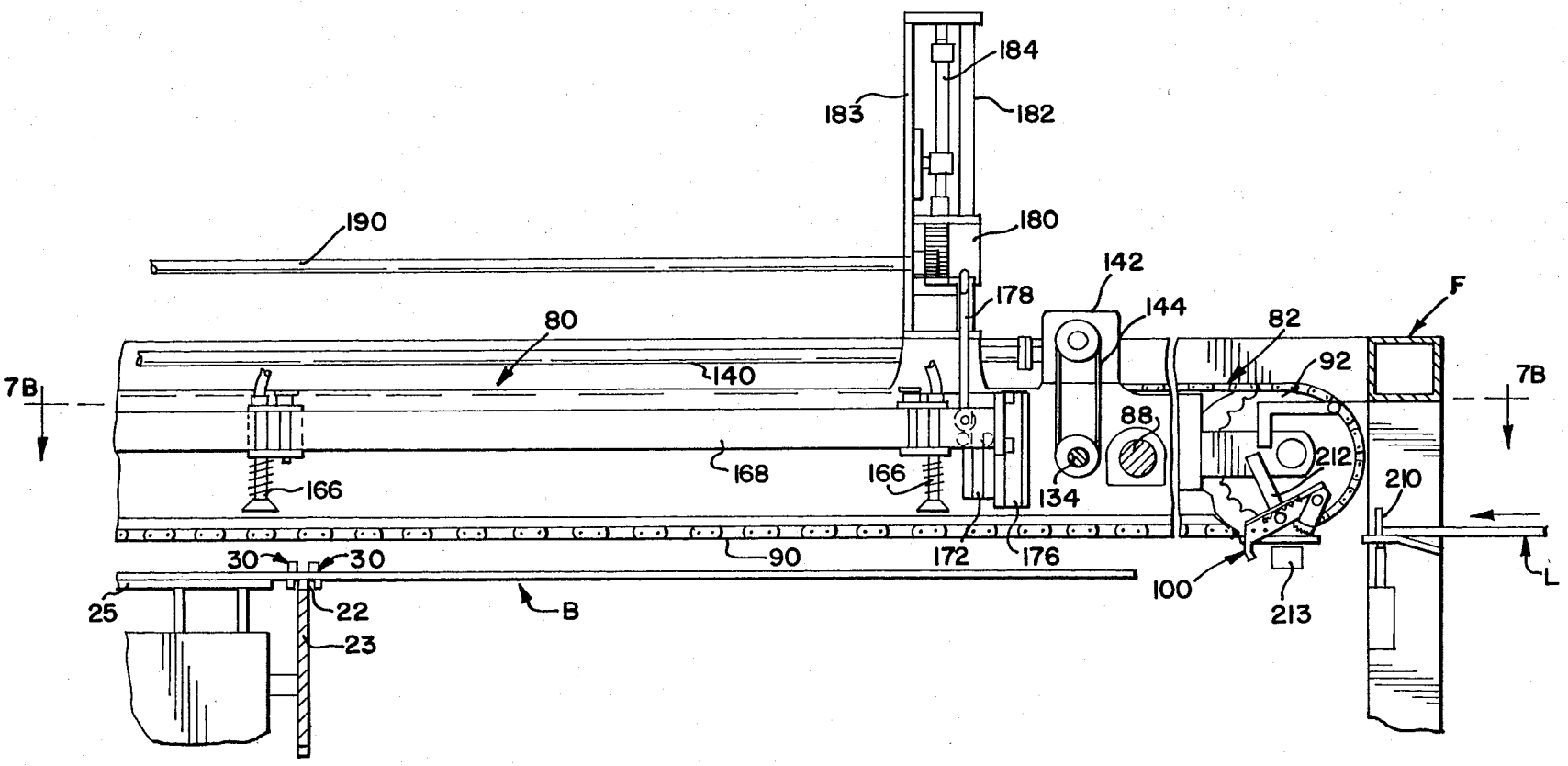
Figure 32:
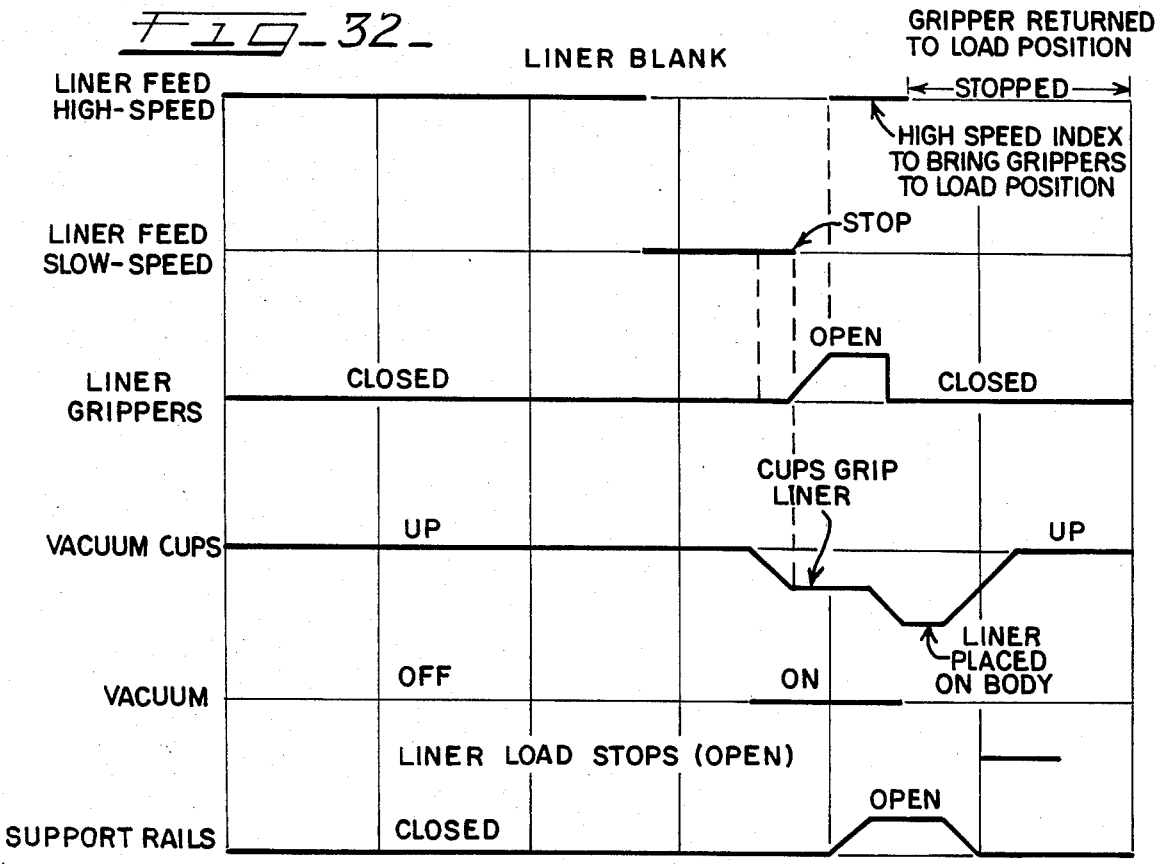
FIG. 32 is a timing chart illustrating operation of the present apparatus for effecting lamination of a liner to a container body blank.

FIG. 32 is a timing chart illustrating operation of the various components of the present apparatus at lamination station 16 in timed relation to each other. As shown in FIGS. 6B and 7B, a pair of vertically movable liner load stops 210 are provided for preventing insertion of a liner L into the apparatus unless the pair of gripper assemblies 100 of the liner conveyor 82 are in position to receive the liner. A proximity switch 212 senses this "ready-to-load" position of the grippers 100, while suitable sensing means are further provided to signal disposition of release plates 120 of support rails 84 and 86 in the closed position for receiving a liner. With the grippers in the ready position and the release plates 120 of support rails in their inner, support position, the liner stops 210 are lowered, so that an operator can advance the leading edge of a liner into the grippers 100. In this regard, and in distinction from the manner in which grippers 30 of the body blank conveyor receive the leading edge of the body blank, liner L is inserted into the jaw mechanism of grippers 100 until it abuts surface 103 within the jaw cavity. While a liner is being loaded into one of the pairs of grippers of the conveyor 82, the previously loaded liner may be being lowered onto a body blank by vacuum cups 166.

As noted, sensing means are provided for signalling the body blank conveyor to indicate that a liner is in a position in association with liner conveyor 82 for advancement by the liner conveyor. The liner is in such an advancement position when it has been received by grippers 10, and the liner is ready to be advanced or is being advanced by the liner conveyor. Sensing means 213 (FIGS. 6B, 7B) is preferably provided to signal disposition of a liner in such association with the liner conveyor grippers. The sensing means 213 operates through automatic controls of the apparatus in conjunction with sensor 204 to control the body blank conveyor to prevent advancement of a body blank from the blank loading end 12, and the attendant application of laminating adhesive to the body blank, unless a liner is in either (1) the position in association with the liner conveyor for advancement (as sensed by sensing means 213) or, (2) the stopped position above the body blank work path (as sensed by sensor 204).

With further reference to the timing chart in FIG. 32, automatic controls signal drive motor 96 of the liner conveyor to index the liner into position at high speed until the leading edge of the liner is beneath the "slow" sensor 202 of the stop assembly. Indexing of the liner conveyor for liner advancement will not take place until any previously fed liner has been lowered onto a body blank by vacuum cups 166, and the vacuum cups 166 have been moved to a position above the path along which a liner is advanced by conveyor 82. During advancement, the opposite edges of the liner are received and confined by channels 118 of support rails 84 and 86, with the parallel configuration of the support rails facilitating accurate advancement of the liner into a "squared up" right angle position with respect to the work path of a body blank.

As the liner L is advanced by the liner conveyor 82 at the conveyor's slow index speed, the leading edge of the liner moves into alignment with the "stop" sensor 204 thus signaling the conveyor to stop advancement of the liner. As illustrated in FIG. 32, during the slowing and stopping of liner advancement, vacuum cups 166 begin to descend by operation cylinders 184. By vacuum inducing means (not shown) the application of negative pressure is operatively joined to each of the vacuum cups 166, with the vacuum cups gripping the liner as they move into contact with it.

As the vacuum cups 166 grip the liner, conveyor grippers 100 are opened by the action of cam bars 194, with the automatic controls of the apparatus signaling the conveyor 82 to index at high speed so that the grippers 100 are moved clear of the leading edge of the liner prior to application to the body blank therebeneath. Release plates 120 of support rails 84 and 86 are opened by operation of their respective release cylinders 124, and vacuum cups 166 continue to move downwardly, thus lowering the liner L into superposition on a body blank in the lamination station to which adhesive has previously been applied, and applying pressure to the liner by virtue of the downward spring-loading of the vacuum cups with respect to mounting rails 168. The vacuum in cups 166 is relieved to release the liner therefrom, and the cups 166 moved vertically to their uppermost position by the action of cylinders 184. Release plates 120 of the support rails 84 and 86 are again closed. The other pair of grippers 100 of the liner conveyor 82 have been moved into the load position as the conveyor was indexed to move the other pair of grippers clear of the leading edge of liner L before it was lowered. Thus, liner load stops 210 are again lowered, and the cycle is repeated.

Advancement of the laminated liner/body blank (or a body without a liner) from lamination station 16 to folding station 18, and folding of the laminated body blank about its parallel score lines E will next be described.

As the body blank conveyor indexes body blank B with liner L thereon out of lamination station 16, the blank is supported on laterally spaced telescopic supports 218. Suitable adhesive-applying means 220 (FIG. 23) apply adhesive to flap portion J of the body blank (or to the portion of liner L over flap J if the liner covers the flap), or the flap portion J' of a laminated body blank, for formation of the manufacturer's joint. As previously noted, a combination of hot melt and cold set adhesives are preferably employed. While adhesive is ordinarily applied to the flap J of body blank B, it will be appreciated that adhesive can additionally or alternatively be applied to the lower surface of the panel S which is opposite from flap J. After the body blank has been transported by grippers 30 of the body blank conveyor to folding station 18, the conveyor is preferably stopped and generally identical folding arm mechanisms 222 at opposite sides of the conveyor are actuated.

Figure 23:
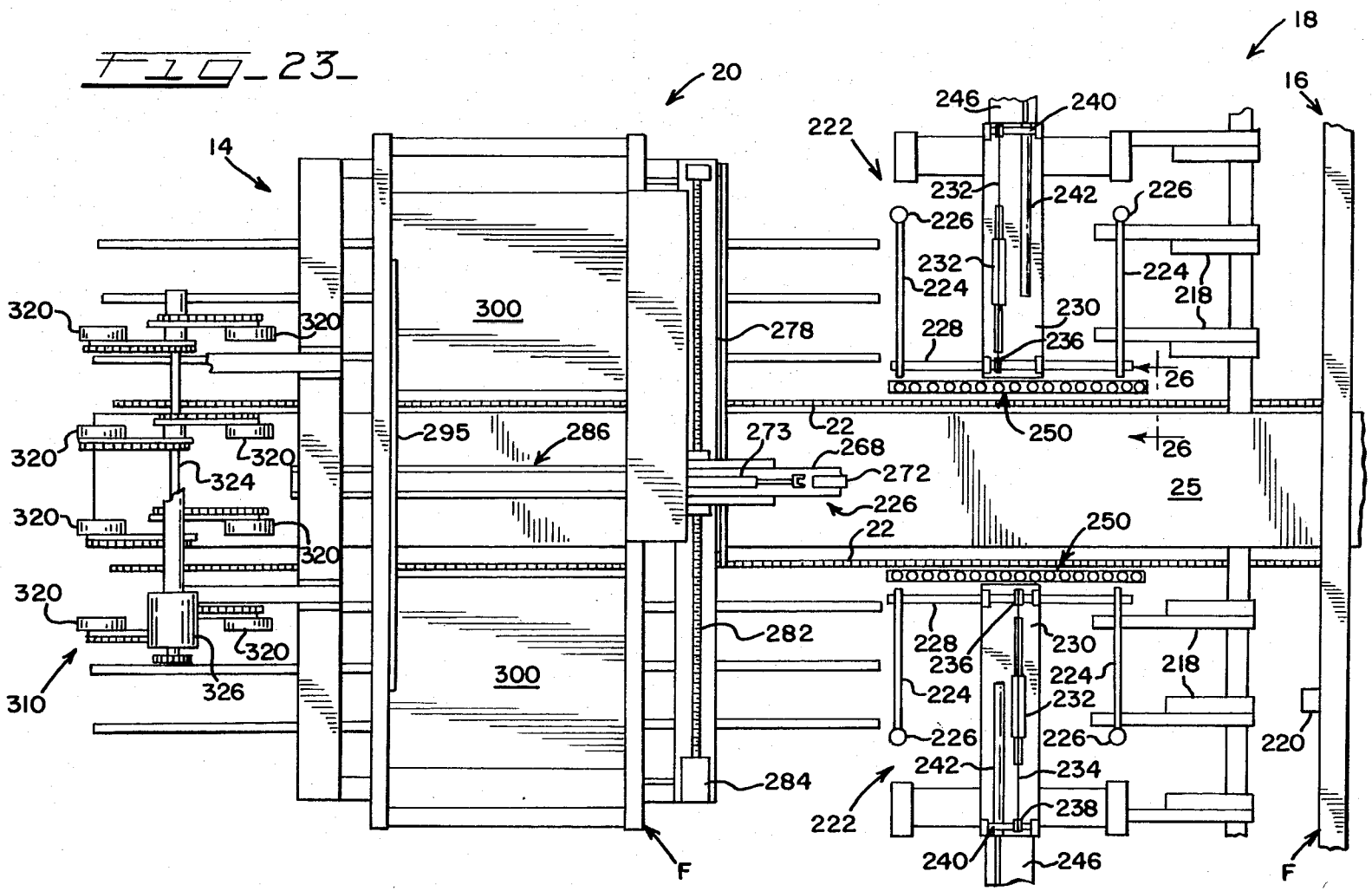
FIG. 23 is a partial top plan view of the present apparatus illustrating a blank folding station, a pressure-applying station, and an outfeed control arrangement.
Figure 24:
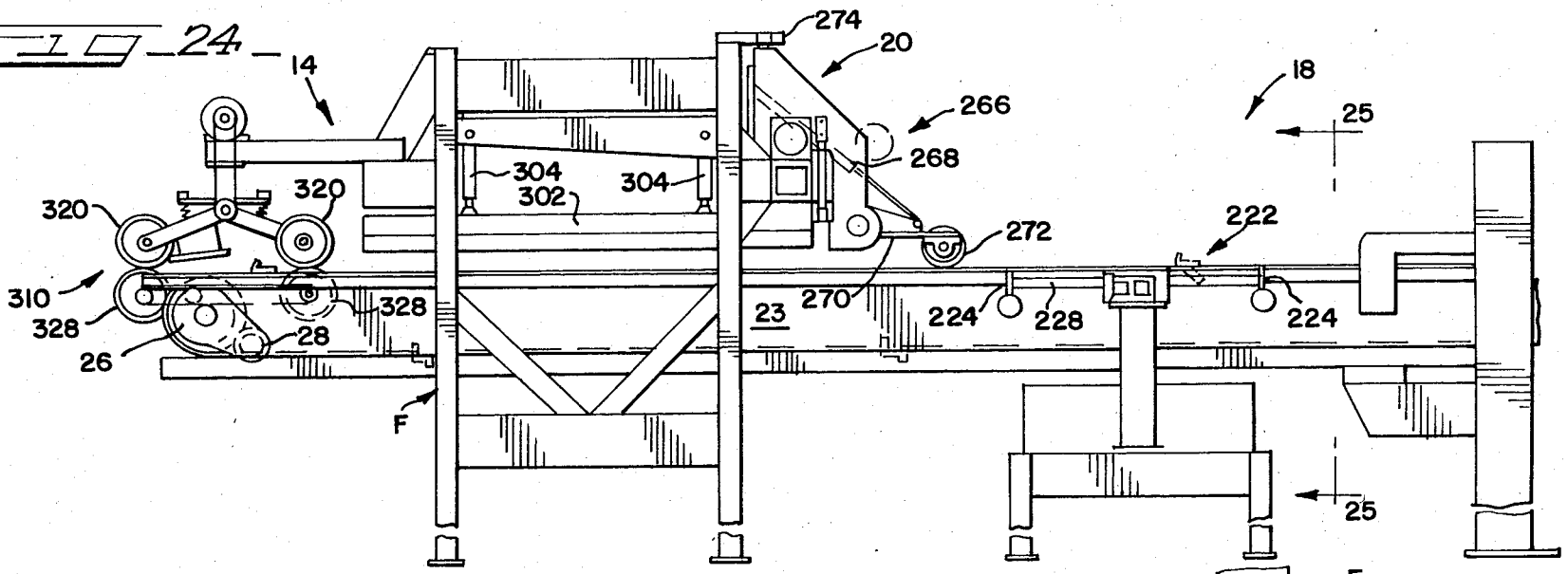
FIG. 24 is a side elevational view of portions of the present apparatus generally shown in FIG. 23.
Figure 25:
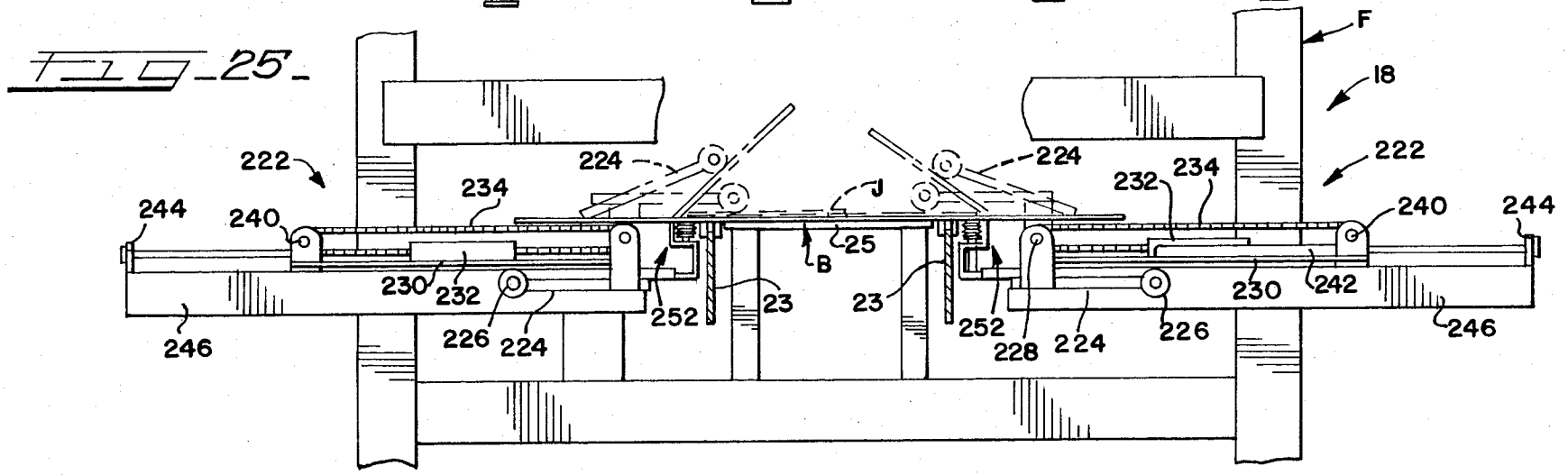
FIG. 25 is a view taken along line 25—25 of FIG. 24 illustrating the blank folding station of the present apparatus.

As shown in FIGS. 23, 24, and 25, each folding arm mechanism 222 includes a pair of spaced folding arms 224 each having a preferably spherical blank engaging roller 226 at the free end thereof. Use of spherical rollers 226 permits initiation of the folding cycle before the body blank is completely stopped. The opposite ends of each pair of arms 224 are secured to a shaft 228 rotatably supported on a frame 230, with the shafts 228 rotatable about respective axes parallel to and disposed below the body blank work path. As shown in FIG. 25, the body blank conveyor moves a gripped body blank B (and liner L if the blank is laminated) into folding station 18, with arms 224 located in a position illustrated in solid line in FIG. 25 such that the arms are disposed below the horizontal work path of the blank.

Suitable actuating means are provided for simultaneously pivoting both pairs of folding arms 224 after the body blank has come to rest in the folding station for folding the blank about its spaced parallel scored lines E. To this end, each folding mechanism includes a double-acting fluid ram 232 which is connected to a chain 234. The chain 234 of each folding mechanism is entrained about a first sprocket 236 fixed to shaft 228, and a second sprocket 238 fixed to a shaft 240 rotatably mounted on frame 230. Operation of fluid rams 232 in one direction causes the chains 234 to pivot the folding arms 224 from the full line positions shown in FIG. 25, through an intermediate position and a fully folded position as further shown in phantom line in FIG. 25. Actuation of fluid rams 232 in an opposite direction reverses the movement of the folding arms 224 back to their initial position below the work path of body blanks B.

As shown in FIG. 23, the folding arm mechanisms 222 are located directly opposite of one another on respective sides of the body blank conveyor. In this regard, the spaced folding arms 224 on one side of the conveyor are aligned with the folding arms 224 on the opposite side of the conveyor. Thus, when fluid rams 232 are actuated to pivot the folding arms 224 upwardly, the rollers 226 on both pairs of the folding arms will simultaneously engage body blank panel portions S so that substantially equal and oppositely directed folding forces are applied to the blank B. Gripper mechanisms 30 of the body blank conveyor positively grip the leading edge of the body blank during folding in this manner, and thus a clean and sharp break is achieved at score lines E (and concurrently at score lines H of liner L if the blank is laminated). The rollers 226 preferably engage the panel portions S at a point spaced about three-quarters of the panel dimension away from score lines E. The folding arms are thus preferably configured for adjustment of their length.

The control arrangement for the fluid rams 232 is preferably arranged so as to provide differential movement of each pair of arms at approximately the midpoint of the folding arm movement. Thus, the folding arm mechanism 222 at one side of the body blank conveyor is caused to move more slowly than the folding arm mechanism at the opposite side of the conveyor. This ensures that the flap J of the body blank will be brought into the desired juxtaposed surface-to-surface relationship with the edge of the panel at the opposite side of the blank without interference. Adjustability of the controls is preferably provided to permit the operator to select which set of folding arms will precede the other.

Folding arm mechanisms 222 are movable inwardly and outwardly relative to the body blank conveyor so as to provide an arrangement for accurately locating the pivot axes of shafts 228 in the desired positions relative to the parallel score lines of the blank. Such adjustment means also facilitates versatile use of the present apparatus for accommodating blanks of varying size. The adjustment arrangement includes a fluid ram 242 having its cylinder end portion mounted on the frame member 230, and having its rod end connected to a member 244 secured to a fixed frame 246. Each frame 230 is arranged for movement relative to its respective fixed frame 246 by appropriate operation of rams 242. Independent adjustment of the rams 242 further facilitates versatility of the present apparatus.

While grippers 30 of the body blank conveyor act to maintain the central portion of the body blank between its score lines E generally in the plane of the horizontal body blank work path, it is presently preferred to further maintain the central portion of the blank in position by application of vacuum to the lower surface thereof. To this end, a pair of vacuum-applying means, generally designated 250, are provided in respective operative association with the folding mechanisms 222, and preferably are arranged for adjustable movement toward and away from body blank conveyor by operation of fluid rams 242.

Each vacuum-applying means 250 is positioned on a respective side of the body blank conveyor. The arrangement includes a plurality of vacuum cups 252 (FIG. 26) which as illustrated are of a pleated, bellows-like collapsible construction. Specifically, this type of vacuum cup is configured to "shorten" or flex and collapse as it is applied to the lower surface of the body blank B, and thus desirably tends to pull the body blank downwardly and maintain the portions of the blank between score lines E generally in the plane of the horizontal work path of the blank during folding. Thus, secure retention of the blank is effected even if the blank is warped or exhibits other irregularities.

The vacuum cups 252 are arranged for vertical movement in a pair of frame members 254, with a bracket 256 respectively connecting each of the frame members 254 to a respective one of the movable frames 230 of the associated folding mechanism 222. By this construction, the vacuum cups 252 are adjustably movable inwardly and outwardly with respect to the centerline of the body blank work path together with the folding mechanisms.

A presently preferred arrangement for creating a vacuum within the cups 252 comprises vacuum-inducing means 258, including a vacuum-inducing venturi 259 for each cup, and a compressed air manifold 259' operatively joined to the venturis 259. Such an arrangement is preferred for several reasons. First, introduction of compressed air into the manifold for creation of vacuum at all the associated venturis can be cycled quite quickly and intermittently, without resort to vacuum pumps and valving or the like. Further, such an arrangement operates such that the vacuum within any one of the various cups is independent of the condition of the other cups. In other words, even if any of the cups 252 are uncovered, this does not diminish the vacuum created within the other cups.

As illustrated in FIG. 26, vacuum cups 252 are positioned just below the horizontal work path of the body blank B as the blank is advanced into folding station 18. After the body blank conveyor stops, the automatic controls of the apparatus act to raise each bank of vacuum cups by operation of suitable fluid ram means 260. The cups 252 are thus moved upwardly into contact with the lower surface of the body blank, with the collapsible nature of the cups acting to very firmly retain and grip the lower surface of the blank. If the body blank is warped, the cups 252 engaging it will collapse under vacuum and draw adjacent portions of the blank progressively downwardly so that all the cups under the blank will draw the blank down to the plane of the work path. By application of vacuum to the portions of the body blank inside of and preferably adjacent to score lines E about which folds are formed, folding is effected without lifting of the portions of the body blank within score lines E.

After folding of the body blank B (and its laminated liner if supplied) by the folding mechanisms 222 more than 90 degrees, the vacuum in cups 252 is released and the cups are lowered. When the body blank is folded, the body blank conveyor again indexes and advances the blank into compression station 20. Even if the body blank is unlaminated, pressure should be applied to the adhesive joint formed at flap portion J to assure the integrity of the joint. If a liner has been laminated to the blank, not only should pressure be applied to the adhesive joint at J, but pressure should also be preferably applied throughout the surface of the folded and laminated blank to assure the integrity of the lamination.

In order to apply pressure to the adhesive joined at flap J, the present apparatus includes a hold-down mechanism generally designated to 266. The hold-down mechanism includes a support member 268 which pivotally supports a spring-biased arm 270 having a hold-down roller 272 rotatably mounted thereon. A fluid ram 273 is selectively operable to raise and lower the pivot arm 270 for forcing hold-down roller downwardly for applying pressure to the adhesive joint at flap J as body blank B is indexed by the blank conveyor from the folding station 18. This action brings the juxtaposed portions of the body blank into intimate contact so that the adhesive thereon is distributed into intimate adherent relationship with respect to the overlapping portions of the body blank. Spring-biasing of arm 270 maintains hold-down roller pressure for various thicknesses of the manufacturer's joint.

For some applications, it can be desirable to operate folding mechanisms 222 such that folding arms 224 do not completely fold a body blank to move flap portion J into contact with its mating portion of the blank. Rather the folding mechanisms are operated to position the flap portion J in close association with its mating portion of the body blank, with hold-down roller 272 then moved downwardly to relatively move the flap portion J and its mating portion into contact and juxtaposition and to apply pressure to the manufacturer's joint as the body blank conveyor is indexed. Thus, for such applications, the folding arms 224 are not withdrawn until after the blank conveyor has started to advance the blank beneath hold-down roller 272.

Notably, versatility of the present apparatus is enhanced by mounting of hold-down mechanism 266 for selective positioning in the direction transversely of the body blank work path. To this end, support member 268 is guided and supported for movement by an upper track 274 on frame F which receives an upper roller 276 mounted on the support member 268. The support member is further supported by a lower track 278 on frame F, with a lower roller 280 carried by the support member riding along the upper surface of the track 278. A powered lead screw drive 282 is operatively connected with the support member, with the selective rotation of the screw drive by drive motor 284 acting to drive the support member transversely of the body blank conveyor. This feature of the present apparatus greatly facilitates its convenient adjustment for folding and gluing body blanks of varying sizes, regardless of the disposition of the flap portion J of the body blank with respect to the centerline of the body blank conveyor.

Figures 28, 29:
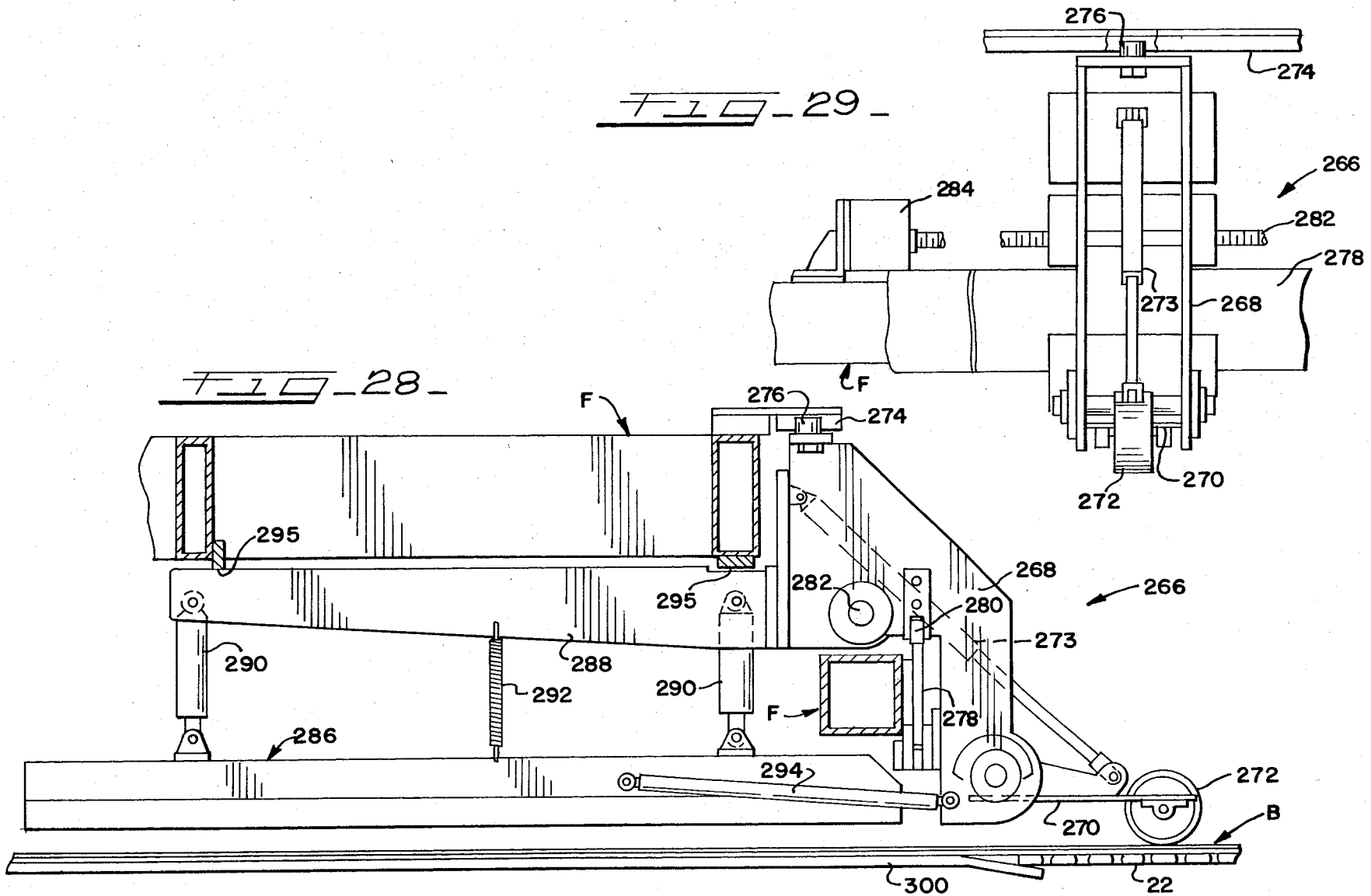
FIG. 28 is a side elevational view of a pressure-applying arrangement of the present apparatus.
FIG. 29 is an end view of the pressure-applying arrangement shown in FIG. 28.

As noted, use of the present apparatus for formation of a laminated body blank having a liner calls for application of pressure substantially throughout the entire surface of the folded and laminated blank at compression station 20 in a preferred embodiment of the invention. However, when the body blank B is unlined, it is only desired that pressure be applied to flap portion J at the manufacturer's adhesive joint. To this end, FIGURE 28 illustrates a modified form of the hold-down mechanism 266 which includes a relatively narrow hold-down platen 286 mounted for transverse movement with support member 268 (platen 286 is further illustrated in FIG. 23). This modified form of the hold-down mechanism can be employed in an apparatus configured for folding and gluing (without liner lamination) of a body blank. The platen 286 is carried by a support 288 which is cantilevered in a downstream direction from the support member 268. A pair of fluid rams 290 extend between the cantilevered support 288 and the hold-down platen 286 whereby actuation of the rams 290 moves the platen downwardly for applying pressure to the manufacturer's joint of the body blank as it is held in a stopped position by the body blank conveyor. The blank-engaging surface of platen 286 is preferably resilient.

Tension spring means 292 extends between support 288 and the platen 286 to assist in moving the platen upwardly after pressure has been applied to the adhesive joint of the body blank. A stabilizer arm 294 further joins the platen 286 to the support member 268 for guided vertical movement of the platen with respect to the support member. Notably, the cantilevered support 288 is configured to react against reaction members 295 fixed to frame F at compression station 20 so that the upward force generated by rams 290 attendant to application of pressure are transferred substantially directly into the apparatus frame. In view of the mounting of platen 286 on the support member 286, the platen can be selectively positioned in a direction transversely of the body blank work path together with the hold-down roller 272 by operation of screw drive 282.

When the folded body blank B is positioned in compression station 20, it is supported in the work path by lower support plates 300. When the apparatus 10 is not configured for liner lamination, the hold-down platen 286 described above can be operated at the compression station for applying pressure to the manufacturer's adhesive joint while the body blank conveyor is stopped. However, for lamination of a liner to the body blank, the compression station preferably includes compression platen means 302 (not shown in FIG. 23) which are vertically moved by fluid rams 304 to compress and apply pressure to the folded and laminated blank. The compression platens 302 are preferably provided with resilient lower surfaces for applying a compressive force to the folded blank at the compression station 20. The platens apply pressure to the folded and laminated body blank for a sufficient period of time to enable the adhesive applied to the blank to remain set once the folded blank is discharged from the apparatus at discharge end 14. When the apparatus 10 is equipped with three compression platens 302 as shown, but liner lamination is not being effected, any one of the platens can be operated for application of pressure to the manufacturer's joint of a folded body blank.

Figure 31:
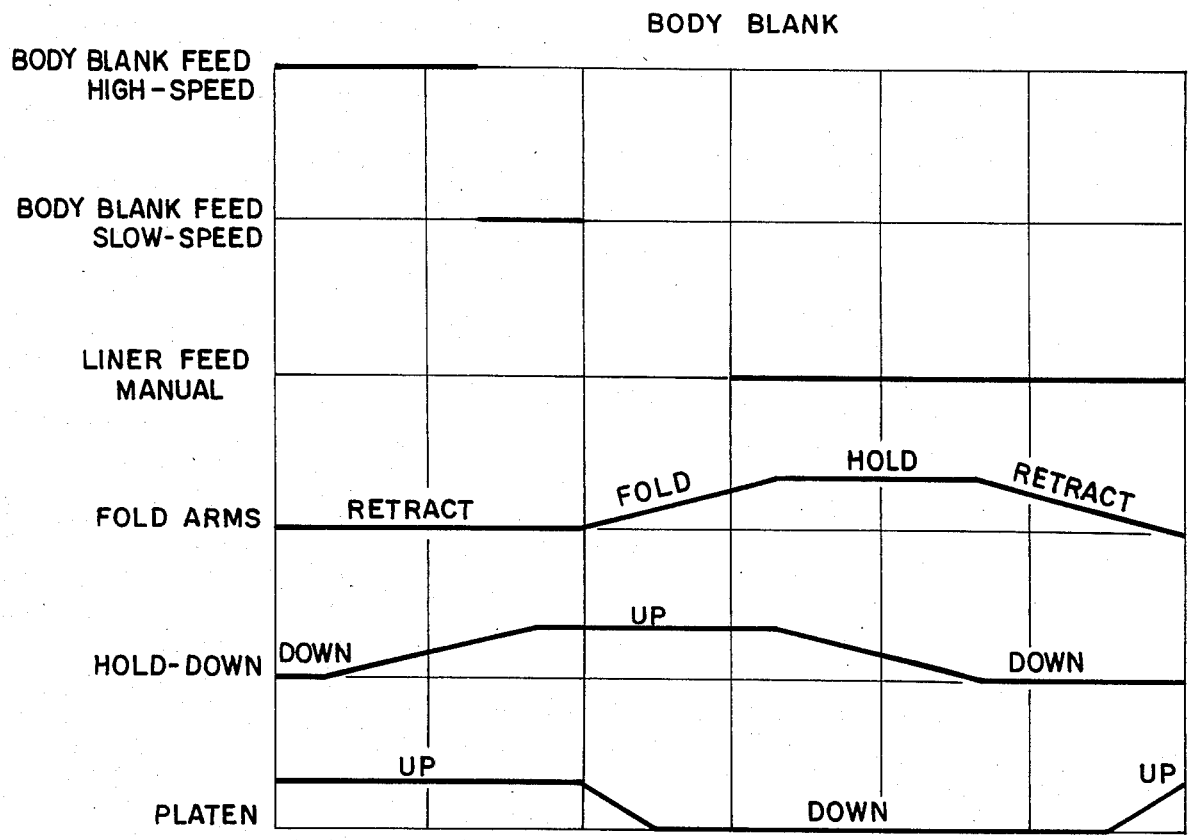
FIG. 31 is a timing chart illustrating operation of the present apparatus for effecting folding and gluing of a container body blank.

FIG. 31 is a timing chart which illustrates operation of folding arms 224, pressure-applying platens 302 (or platen 286), and the body blank indexing conveyor in timed relation to each other. For some applications, the timing can be modified to reduce or increase the time required for a complete cycle. In this regard, timing means is preferably provided for selectively varying the "down" time of the pressure-applying platens 302 (or platen 286) for obtaining effective adhesion, with variation in this time correspondingly affecting the overall cycle time.

As previously discussed, the gripper assemblies 30 of the body blank conveyor each include an abutment member 38 at the forward portion thereof. While this abutment member can be employed for ejecting a previously folded body blank from the apparatus (after such a previous blank has been released from its gripper assemblies), it is presently preferred that the abutment member of the grippers only be used for such a function during low-speed operation or "jogging" of the apparatus. During fully automated, normal high-speed operation, engagement of the abutment members 38 of the gripper assemblies with the trailing edge of the previously folded blank can possibly undesirably mar the previous blank.

Figure 30:
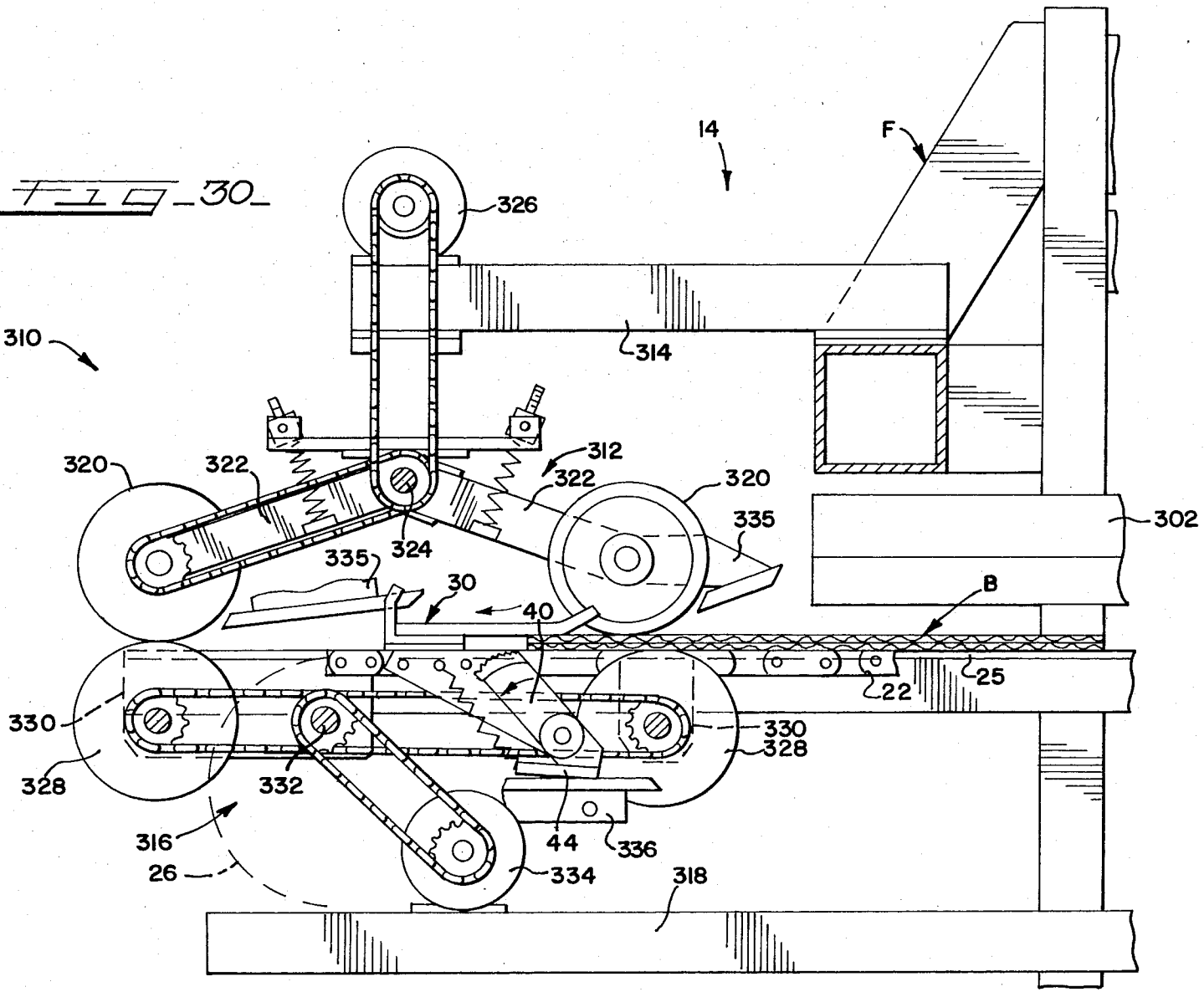
FIG. 30 is a side elevational view illustrating an outfeed control arrangement at the blank discharge end of the present apparatus.

Accordingly, the illustrated embodiment of the present apparatus includes an outfeed control mechanism, generally designated 310 (see FIGS. 23 and 30). Significantly, the outfeed control mechanism is configured to receive a folded (and laminated) body blank from the body blank conveyor, and eject the folded blank from the apparatus at a rate less than the rate of advancement of the blank by the blank conveyor. This action is effected by the provision of an upper roller assembly 312 carried by a support 314, and a lower roller assembly 316 positioned upon a support 318. In the illustrated embodiment, the upper assembly 312 includes four laterally spaced pairs of upper rollers 320 each carried on a spring-loaded arm 322. Each of the rollers 320 is operatively connected with a drive shaft 324 by suitable chains, as illustrated, with the shaft 324 in turn driven by a drive motor 326 for driving the rollers 320 concurrently in a clockwise direction, referring to the orientation of FIG. 30.

In the preferred form, the lower roller assembly 316 includes a plurality of lower rollers 328 which preferably correspond in number to the upper rollers 320, and which are preferably respectively positioned generally below each upper roller 320 on supports 330. In the preferred embodiment, the lower rollers 328 are configured for rotation together by operative connection with chains or the like to a shaft 332, which is in turn driven by a drive motor 334 connected to the shaft 332 by a suitable drive chain or like means.

In order to reduce the rate of advancement of the body blank B as the body blank enters the outfeed control mechanism 310 as it is drawn by each pair of gripper assemblies 30 of the body blank conveyor, either the upper rollers 320 or the lower rollers 328, and preferably both the upper and lower rollers, are continuously driven at a rate which is less than that of the rate of advancement of the body blank by the blank conveyor. Guides 335 are preferably provided on the arms 322 of the upper roller assembly to direct the leading edge of the folded blank B into the "nip" of each vertically aligned pair of upper and lower rollers.

To release the leading edge of the body blank from each pair of gripper assemblies 30 on conveyor chains 22, suitable release cam means 336 are provided in operative association with the outfeed control mechanism. The release cam means 336 react against the cam plates 44 of the gripper assemblies 30 as the body blank conveyor advances the leading edge of the blank into the outfeed control mechanism. Engagement of the upper and lower rollers 320 and 328 acts to slow the rate of advancement of the body blank (preferably to a speed on the order of 90% of the rate of advancement of the blank by the conveyor).

The leading edge of the blank is released from the gripper assemblies 30 as the blank is received between the upstream ones of the upper and lower rollers 320 and 328, and the gripper assemblies move out of the way about their respective sprockets 26 to the lower runs of conveyor chains 22. The preferred spring-loading of each of the upper rollers 320 assures that the rollers are urged into driving relationship with the body blank, and permits the rollers to conform to the contour of the blank, such as when the manufacturer's adhesive joint passes beneath any of the rollers. In the preferred form, drive motors 326 and 334 comprise suitable hydraulic motors connected in series flow relation to assure that the motors, and thus the upper and lower rollers, operate at the same speed.

Such a hydraulic drive arrangement facilitates advancement of a blank through the outfeed mechanism when the present apparatus is in a "non-run" or "jog" mode since during operation in such a mode, the outfeed control mechanism 310 is not powered. Rather, ejection of the body blanks from the machine is effected by engagement of abutments 38 of the next trailing pairs of gripper assemblies 30 of the body blank conveyor with the trailing edge of the blank which is about to be ejected from the apparatus. Since the rollers at the outfeed control mechanism are urged into contact with the body blank, the drive arrangement of the hydraulic motors 326 and 334 is configured to permit the rollers 320 and 328 to "free wheel" as the blank is ejected from the apparatus in this manner.

During normal fully automated operation, each body blank is released from the gripper assemblies of the body blank conveyor, and is ejected from the apparatus. The folded and glued blanks are preferably received on a turntable which may rotate 90 or 180 degrees after each folded blank is positioned thereon to alternate the location of the manufacturer's joints for level stacking of the finished container blanks.

Thus, a highly automated and efficient apparatus for high-speed lamination, folding, and gluing of container body blanks is provided by the present invention. Highly versatile use of the present apparatus is facilitated by the various adjustable components thereof, with desirably low "changeover time" required for configuring the apparatus to handle differently sized and configured container blanks and liners. The preferred use of conveyors for liner and body blank advancement each operable at selected high and low speeds provides desirably low cycle time, while facilitating highly accurate and precise placement of a liner with respect to a body blank. The preferred hydraulic operation of the various fluid rams and motors of the apparatus facilitates high speed operation and efficient and positive blank folding, while avoiding the problems frequently associated with pneumatically actuated devices, and the relative inflexibility of typical mechanical drives.

From the foregoing, it will be observed that numerous modifications and variations can be effected by those skilled in the art without departing from the true spirit and scope of the novel concepts of the present invention. It is to be understood that no limitation with respect to the specific embodiments disclosed herein is intended or should be inferred. It is, of course, intended to cover by the appended claims all such modifications as fall within the scope of the claims.

What is claimed is:

1. An apparatus for folding and gluing container body blanks, comprising frame means having a blank loading end and a blank discharge end;

blank conveyor means mounted on said frame means for advancing a body blank along a work path relative to said frame means from said blank loading end to said blank discharge end;

liner conveyor means mounted on said frame means for advancing a liner transversely of said blank conveyor means into a postion above said work path;

support means for supporting said liner above said work path and for confining laterally opposite edge portions of said liner during advancement of said liner by said liner conveyor means;

means positioned in operative association with said liner conveyor means for lowering said liner into superposed relation onto a body blank being advanced along said path by said blank conveyor means to form a laminated body blank, and means for adhering said liner to said body blank comprising means for applying adhesive to one of said liner and said body blank prior to lowering of said liner into said superposed relation to form said laminated body blank;

means positioned in operative association with said support means for releasing said opposite edge portions of said liner from said support means prior to lowering of said liner by said liner lowering means;

means positioned along said work path downstream of said liner lowering means for folding said laminated body blank and for adhering said laminated body blank in a folded condition, said folding and adhering means being upstream of said blank discharge end of said frame means, whereby said blank conveyor means advances said folded and laminated body blank to said blank discharge end of said frame means.

2. An apparatus in accordance with claim 1, including means for selectively adjusting said support means for supporting liners of various widths.

3. An apparatus in accordance with claim 1, including means for selectively adjusting the position of said support means and said liner conveyor means relative to said frame means in a direction parallel to the direction of advancement of said body blank by said blank conveyor means.

4. An apparatus in accordance with claim 1, wherein said lowering means comprises vacuum applying means mounted for vertical movement and positioned in operative association with said liner conveyor means for applying vacuum to said liner, and for lowering said liner onto said body blank after release of said liner from said liner support means.

5. An apparatus in accordance with claim 1, wherein said body blank includes a flap portion, and wherein said means for folding and adhering comprises means for applying adhesive to said flap portion of said laminated body blank, and means for folding said laminated body blank to bring said flap portion thereof into juxtaposition with another portion of said laminated body blank to form an adhesive joint with the adhesive applied to said flap portion for the folded and laminated body blank.

6. An apparatus in accordance with claim 5, including means for applying vacuum to the lower surface of said body blank during folding by said folding means.

7. An apparatus in accordance with claim 5, including means for applying pressure to said adhesive joint prior to advancement of said folded and laminated body blank by said blank conveyor means to said blank discharge end of said frame means.

8. An apparatus in accordance with claim 1, including means for compressing said folded and laminated body blank prior to advancement of said folded and laminated body blank by said blank conveyor means to said blank discharge end of said frame means.

9. An apparatus for folding and gluing container body blanks, comprising:

frame means having a blank loading end and a blank discharge end;

blank conveyor means mounted on said frame means for intermittently advancing a body blank along a straight-line horizontal work path relative to said frame means from said blank loading end to said blank discharge end, said blank conveyor means including at least two laterally spaced gripper means each having a gripper jaw mechanism adapted to receive and grip the leading edge of a body blank at said blank loading end for conveying said body blank along said work path;

liner conveyor means mounted on said frame means for advancing a liner transversely of said blank conveyor means into a stopped position above said blank conveyor means;

liner support means for supporting said liner above said work path, and for confining laterally opposite edge portions of said liner during advancement of said liner to said stopped position by said liner conveyor means, said support means comprising a pair of support rails positioned on respective opposite sides of said liner conveyor means for respective engagement with the opposite edge portions of said liner;

means positioned in operative association with one of said blank conveyor means and said liner conveyor means for applying adhesive to one of said body blank and said liner to form a laminated body blank including said body blank and said liner superposed thereon;

means positioned in operative association with said liner conveyor means for lowering said liner from said stopped position above said blank conveying means onto a said body blank when said body blank is moved to a position beneath said liner and said blank conveyor means is stopped to form said laminated body blank, and means operatively associated with said support means for releasing said opposite edge portions of said liner from said liner support means prior to lowering of said liner by said lowering means;

means along said work path for applying adhesive to a flap portion of said laminated body blank during advancement thereof by said blank conveyor means;

means downstream of said liner lowering means and upstream of said discharge end for folding said laminated body blank about parallel score lines thereof to bring said flap portion into juxaposition with another portion of said laminated body blank to form an adhesive joint for the folded and laminated body blank, said folding means being operated when advancement of said laminated body blank by said blank conveyor means is stopped; and means along said work path for applying pressure to said folded and laminated body blank prior to advancement thereof by said blank conveyor means to said blank discharge end of said frame means.

10. An apparatus in accordance with claim 9, wherein said lowering means comprising a plurality of vertically vacuum applying means mounted for vertical movement together for applying vacuum to the upper surface of said liner to grip said liner and for lowering said liner into superposition onto said body blank after release of said liner from said support rails.

11. An apparatus in accordance with claim 10, wherein said means for applying adhesive to one of said liner and said body blank is mounted on said frame means for applying adhesive to the upper surface of said body blank as said body blank is advanced by said blank conveyor means from said blank loading end into said position of said body blank beneath said liner.

12. An apparatus in accordance with claim 11, including means for controlling said body blank conveyor means for controlling advancement of said body blank along said workpath, including means for sensing disposition of said liner in one of (1) a position in operative association with said liner conveyor means for advancement thereby, and (2) said stopped position above said work path, for controlling said blank conveyor means to prevent advancement of said body blank from said blank loading end until said liner is in one of said positions as sensed by said sensing means.

13. An apparatus in accordance with claim 11, including a pair of laterally spaced stop means disposed along said work path, and body blank conveyor control means for controlling advancement of said body blank along said work path, including means for sensing simultaneous engagement of the leading edge of said body blank with each said stop means when said blank body is advanced by said blank conveyor means from said blank loading end to said position beneath said liner, said control means controlling said blank conveyor means so that said blank conveyor means continues to operate until said simultaneous engagement of said leading edge with said stop means is effected as sensed by said sensing means to thus position said body blank with the score lines thereof in parallel relation to said work path, each said gripper means of said blank conveyor means being configured to permit limited withdrawal of said leading edge of said body blank from the jaw mechanism thereof to effect said simultaneous engagement.

14. An apparatus in accordance with claim 11, wherein said liner conveyor means includes liner conveyor gripper means having a liner jaw mechanism adapted to receive the leading edge of said liner for advancing said liner into said stopped position above said work path, with the opposite edge portions of said liner supported by said pair of support rails during said liner advancement, said apparatus including means for opening said liner conveyor gripper means when said liner is in said stopped position prior to lowering of said liner into superposition onto said body blank.

15. An apparatus in accordance with claim 14, wherein said means for opening said liner conveyor gripper means comprises elongated bar cam means mounted for movement in operative association with said liner conveyor means for operative engagement with said liner conveyor gripper means for opening said liner conveyor gripper means, whereby said opening means is moved to open said liner conveyor gripper means throughout a range of relative positions of said liner conveyor gripper means with respect to said bar cam means.

16. A method of folding and gluing a container body blank, comprising the steps:

providing frame means having blank conveyor means mounted thereon for intermittently advancing a body blank along a straight-line horizontal work path from a blank loading end to a blank discharge end of said frame means;

providing liner conveyor means on said frame means for advancing a liner transversely of and to a stopped position above said work path;

providing support means for supporting and confining opposite edge portions of said liner during advancement thereof by said liner conveyor means;

advancing a liner with said liner conveyor means to said stopped position, while supporting and confining opposite edge portions of said liner with said support means;

advancing a body blank from said blank loading end to a position beneath said liner conveyor means and stopping advancement of said body blank;

applying adhesive to the upper surface of said body blank during said body blank advancing step for forming a laminated body blank including said body blank and said liner superposed thereon;

lowering said liner from said stopped position into superposition onto said body blank to further form said laminated body blank, including releasing the edge portions from said support means prior to lowering of said liner;

applying adhesive to a flap portion of said laminated body blank;

advancing said laminated body blank to a folding station;

folding said laminated body blank at said folding station about a pair of parallel score lines of said body blank to bring said flap portion into juxtaposition with a side panel portion of said body blank to form an adhesive joint with the adhesive applied to said flap portion to thereby form a folded and laminated body blank;

applying pressure to said folded and laminated body blank upstream of said blank discharge end; and advancing said folded and laminated body blank from said discharge end of said frame means.

17. A method in accordance with claim 16, wherein said lowering step includes providing means mounted for vertical movement for applying vacuum to the upper surface of said liner, and lowering said liner into superposition on said body blank with said vacuum applying means after release of said opposite edge portions of said liner from said support means.

18. A method in accordance with claim 17, and sensing the disposition of said liner in one of a (1) position in association with said liner conveyor means for advancement thereby, and (2) in said stopped position, to prevent advancement of said body blank from said blank loading end and the application of adhesive thereto unless said liner is in one of said positions.

19. A method in accordance with claim 17, including orienting said body blank so that the score lines thereof are parallel to said work path prior to superposition of said liner thereon by providing a pair of laterally spaced stop means in operative association with said body blank conveyor means, and operating said body blank conveyor means to advance said body blank from said blank loading end to said position beneath said liner conveyor means until simultaneous engagement of a leading edge of said body blank with said pair of stop means is effected, whereupon said body blank conveyor means is stopped.

20. A method in accordance with claim 17, including providing each of said body blank and liner conveyor means with gripper means for respectively receiving and gripping a leading edge of said body blank and a leading edge of said liner, providing means for opening the gripper means of said body blank conveyor means as said folded and laminated body blank is advanced by said blank conveyor means to said disacharge end of said frame to release said folded and laminated body blank, and providing means for opening the gripper means of said liner conveyor means to release said liner therefrom when said liner is in said stopped position prior to lowering of said liner into superposition on said body blank.

21. A method in accordance with claim 16, including stopping advancement of said laminated body blank during said folding step and applying vacuum to the lower surface of a central portion of said body blank between said score lines thereof during said folding step.

* * * * *